US006834233B2

(12) United States Patent
Economides et al.

(10) Patent No.: US 6,834,233 B2
(45) Date of Patent: Dec. 21, 2004

(54) SYSTEM AND METHOD FOR STRESS AND STABILITY RELATED MEASUREMENTS IN BOREHOLES

(75) Inventors: Michael J. Economides, Houston, TX (US); Wolfgang F. J. Deeg, Duncan, OK (US); Peter Valko, College Station, TX (US); Michael Nikolaou, Houston, TX (US); Sathish Sankaran, Houston, TX (US)

(73) Assignee: University of Houston, Houston, TX (US)

( * ) Notice: Subject to any disclaimer, the term of this patent is extended or adjusted under 35 U.S.C. 154(b) by 443 days.

(21) Appl. No.: 10/071,880

(22) Filed: Feb. 8, 2002

(65) Prior Publication Data

US 2003/0150263 A1 Aug. 14, 2003

(51) Int. Cl.[7] ..... E21B 43/26
(52) U.S. Cl. ..... 702/1; 166/250.1
(58) Field of Search ..... 702/1, 6; 166/250.1, 166/250; 175/45

(56) References Cited

U.S. PATENT DOCUMENTS

| | | | | |
|---|---|---|---|---|
| 4,005,750 A | * | 2/1977 | Shuck | 166/308.1 |
| 4,044,828 A | | 8/1977 | Jones et al. | 73/783 |
| 4,109,717 A | | 8/1978 | Cooke, Jr. | 166/250.1 |
| 4,529,036 A | | 7/1985 | Daneshy et al. | 166/250.1 |
| 4,665,984 A | | 5/1987 | Hayashi et al. | 166/250.1 |
| 4,783,769 A | | 11/1988 | Holzhausen | 367/35 |
| 4,974,675 A | | 12/1990 | Austin et al. | 166/250.1 |
| 5,070,457 A | | 12/1991 | Poulsen | 702/12 |
| 5,318,123 A | | 6/1994 | Venditto et al. | 166/250 |
| 5,360,066 A | | 11/1994 | Venditto et al. | 166/250.1 |
| 5,386,875 A | | 2/1995 | Venditto et al. | 166/308.1 |
| 5,394,941 A | * | 3/1995 | Venditto et al. | 166/255.2 |
| 5,482,116 A | | 1/1996 | El-Rabaa et al. | 166/250.1 |
| 6,070,666 A | | 6/2000 | Montgomery | 166/308.1 |

OTHER PUBLICATIONS

Valko, P. and Economides, M.J., *Hydraulic Fracture Mechanics*, cover page, 11 sheets and pp. 1 through 298 (©1995), John Wiley & Sons, West Sussex, England.

*Multiple Hydraulic Fractures*, Gas Research Institute, http://www.gri.org/pub/oldcontent/tech/e+p/d+c/ast/techdesc/mh-frac/mhfrac.html, 12 pages (Fall 1997).

Chen, Zhongming and M. J. Economides, *Effect of Near–Wellbore Fracture Geometry on Fracture Execution and Post–Treatment Well Production of Deviated and Horizontal Wells*, SPE, Texas A&M University, SPE Prod. & Facilities magazine, No. 14(3), pp. 177–186 (Aug. 1999).

(List continued on next page.)

*Primary Examiner*—John Barlow
*Assistant Examiner*—Victor J. Taylor
(74) *Attorney, Agent, or Firm*—Tim Headley; Gardere Wynne Sewell LLP

(57) ABSTRACT

A system and method for the measurement of the stresses and pressure perturbations surrounding a well, and a system for computing the optimum location for initiating a hydraulic stress fracture. The technique includes using sensors attached to the wellbore casing connected to a data analyzer. The analyzer is capable of analyzing the stresses on the well system. Using an inverse problem framework for an open-hole situation, the far field stresses and well departure angle are determined once the pressure perturbations and stresses are measured on the wellbore casing. The number of wellbore measurements needed for the inverse problem solution also is determined. The technique is also capable of determining the optimal location for inducing a hydraulic fracture, the effect of noisy measurements on the accuracy of the results, and assessing the quality of a bond between a casing and a sealant.

25 Claims, 35 Drawing Sheets

OTHER PUBLICATIONS

*Implementation of Real–Data Fracture Analysis Methodology Improves Treatment Success*, GasTIPS, http://www.gri.org/pub/content/nov/19981103/173221/gts97–f–toc.html, 12 pages (Jun. 1997).

*High Permeability Fracturing of Gas.Wells*, Gas Research Institute, http://www.gri.org/pub/oldcontent/tech/e+p/gastips/fall97/high.html, 10 pages (Fall 1997).

*Hydraulic Fracturing Research—New Concepts Will Change Industry Practices*, Gas Research Institute, http://www.gri.org/pub/oldcontent/tech/e+p/d+c/techfoc/hydrfrac.html, 4 pages (date unknown), printed Feb. 22, 2001.

Brebbia, C.A., *The Boundary Element Method for Engineers*, Pentech Press, Plymouth (1978).

Bui, H.D., *Inverse Problems in the Mechanics of Materials: An Introduction*, CRC Press (1994).

Chen, Z. and M. J. Economides, *Fracturing Pressures and Near–Well Fracture Geometry of Arbitrarily Oriented and Horizontal Wells*, SPE 30531, presented at SPE Annual Technical Conference, Dallas (1995).

Doyle, J.F., *Crack Detection in Frame Structures*, in Inverse Problems in Mechanics, S. Saigal and L. G. Olson (ed.), AMD, vol. 186 (1994).

Trevelyan, J., *Boundary Elements for Engineers—Theory and Applications*, Computational Mechanics Publications, Southampton Boston (1994).

* cited by examiner

Fig. 10 Finite difference model: Radial stresses (uniform grid size)
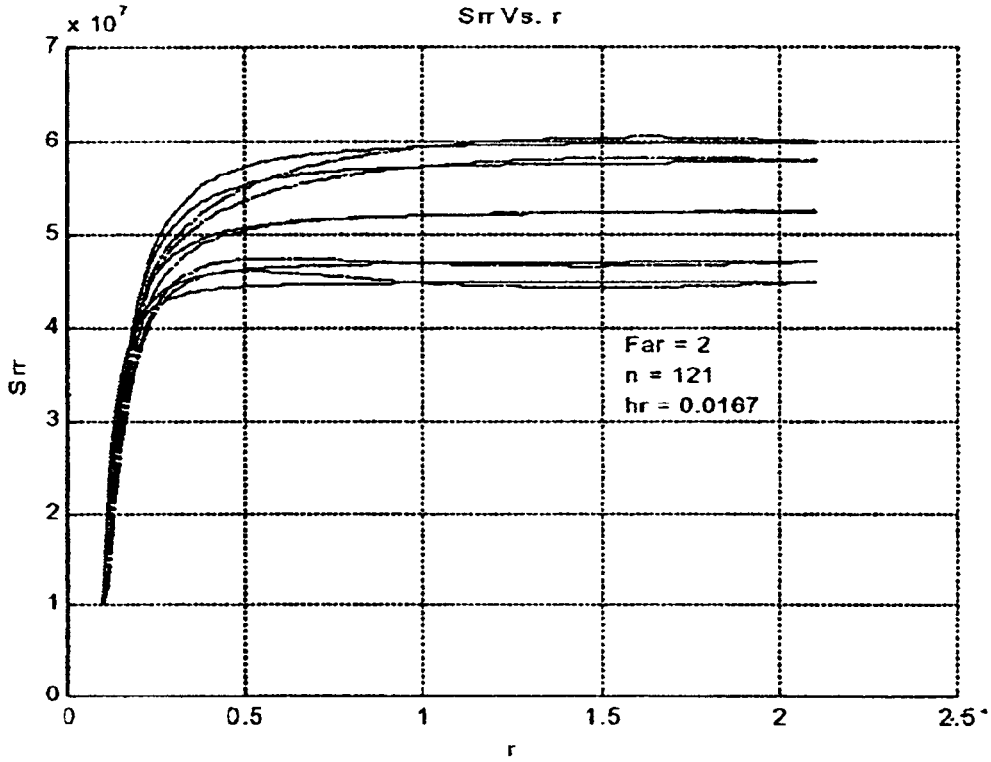
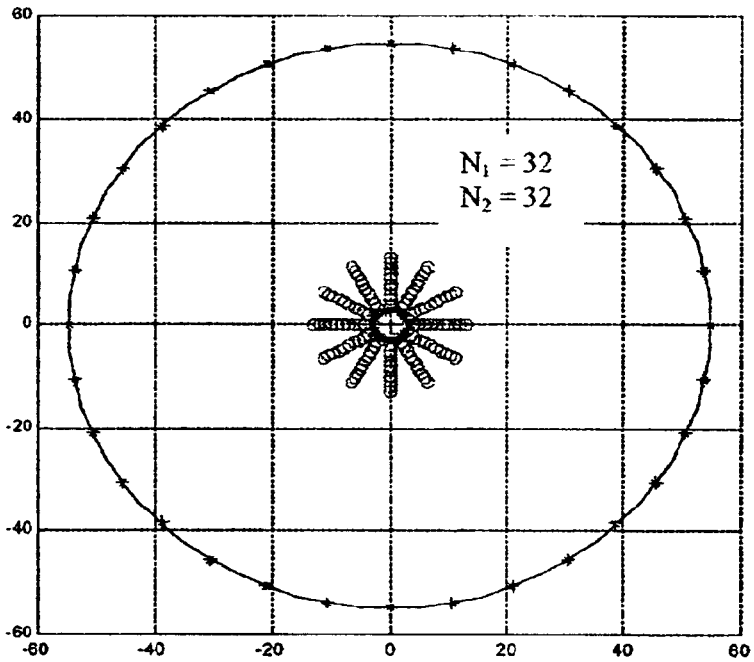
Fig. 11 Boundary elements for inclined well (without fracture)

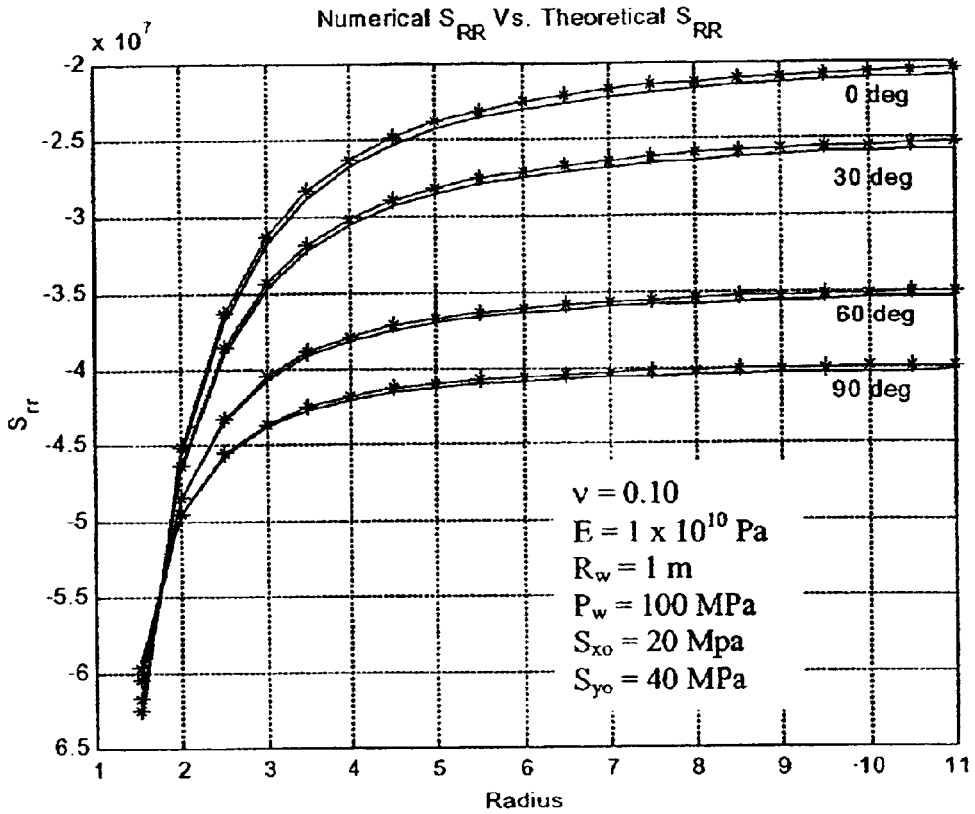
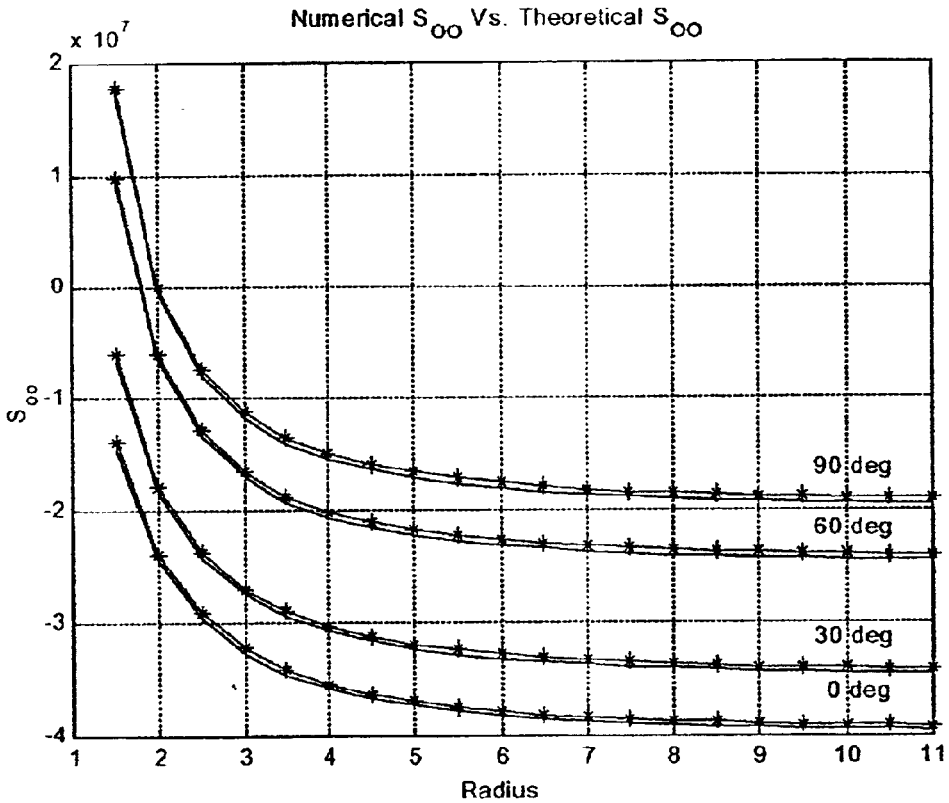
Fig. 12 Boundary Element model for inclined well: Internal stresses

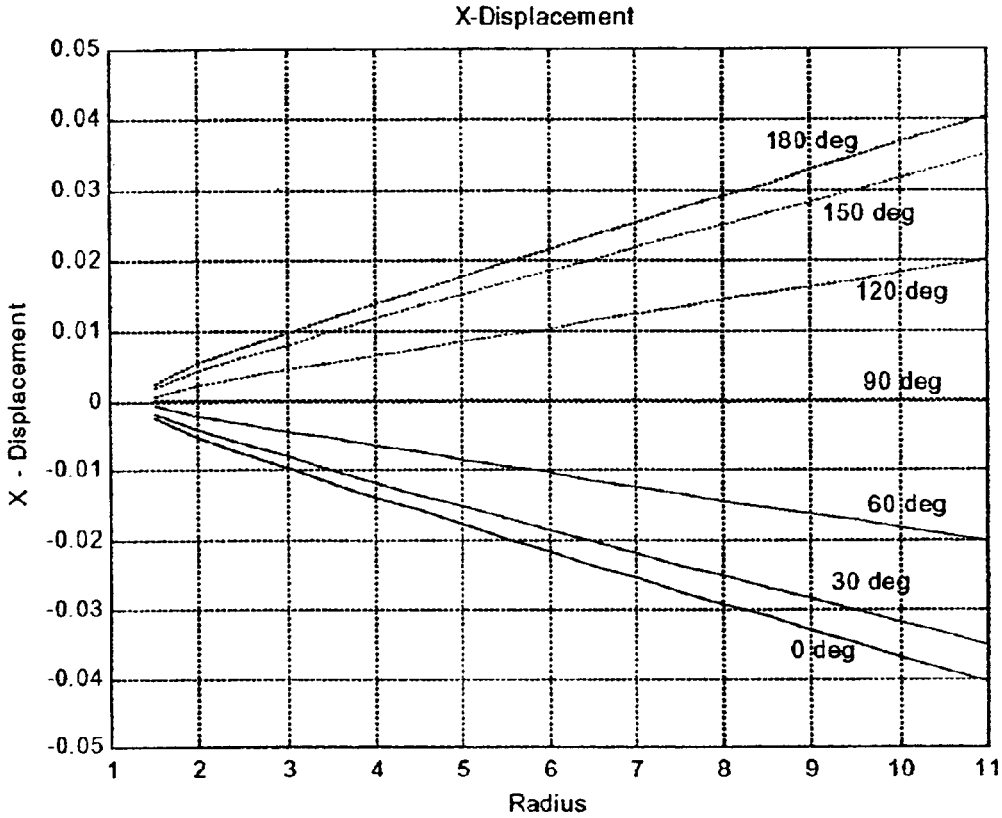
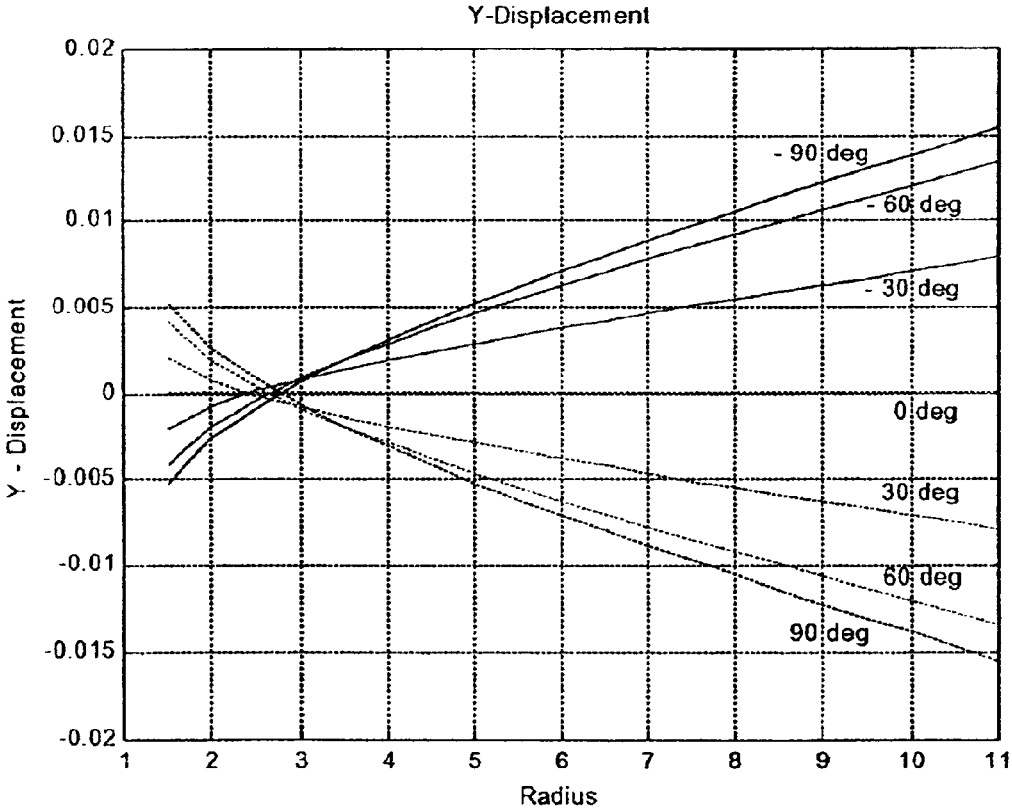
Fig. 13 Boundary Element model for inclined well: Internal displacements Fig. 14 Far-field boundary solution for inclined well: Far-field stresses
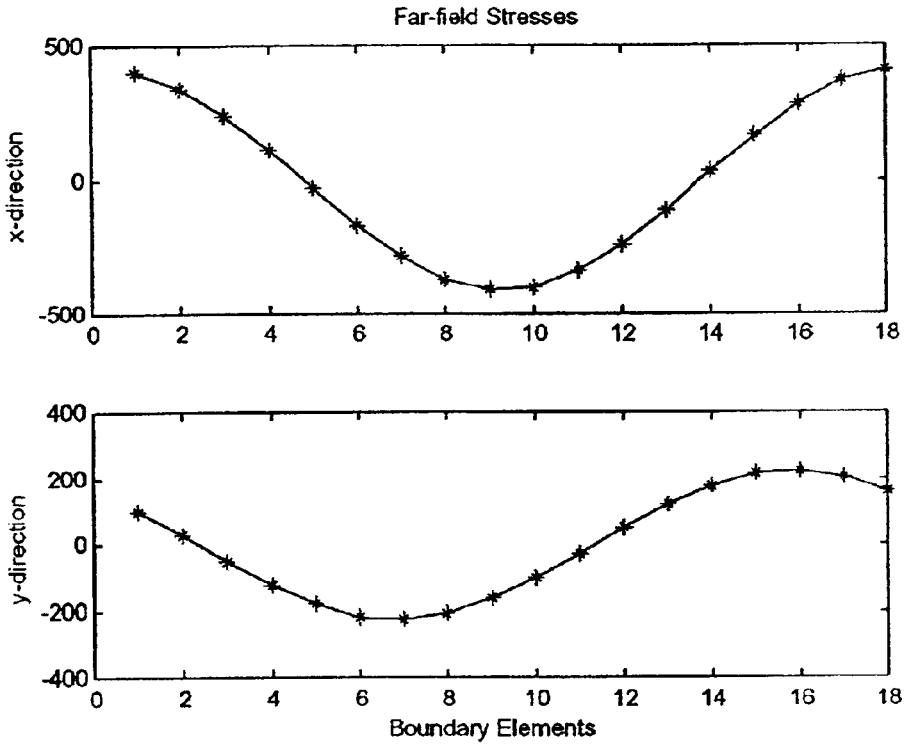
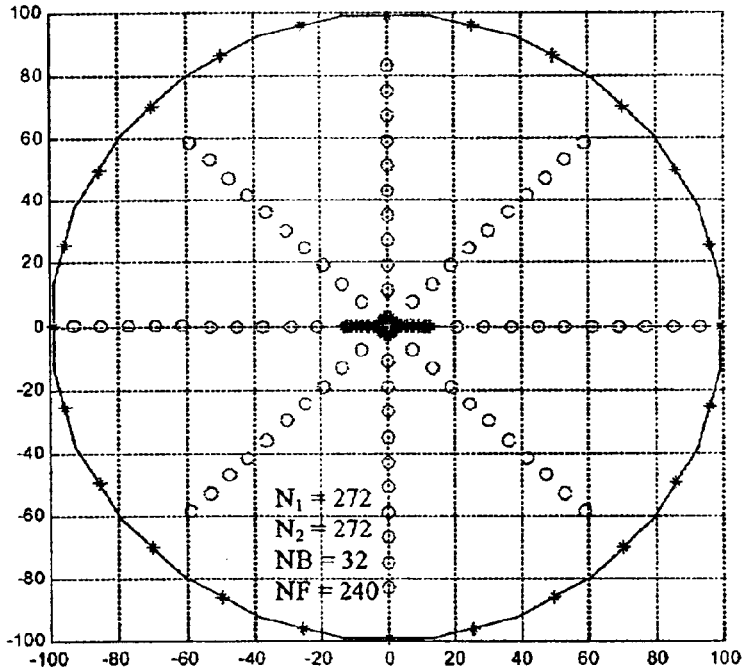
Fig. 15 Boundary elements for vertical well (with fracture)

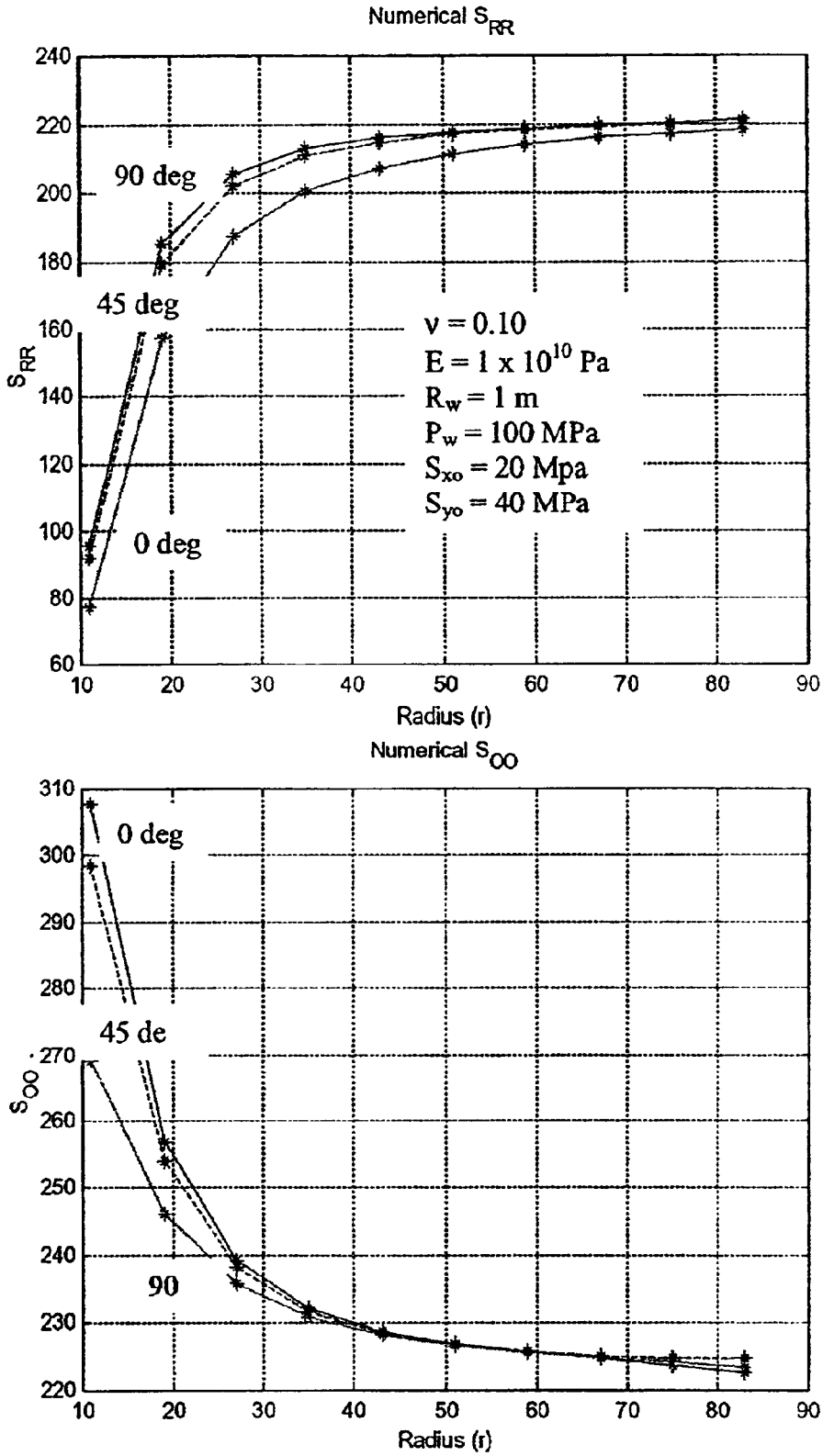
Fig. 16 Boundary Element model for vertical well with fracture: Internal stresses

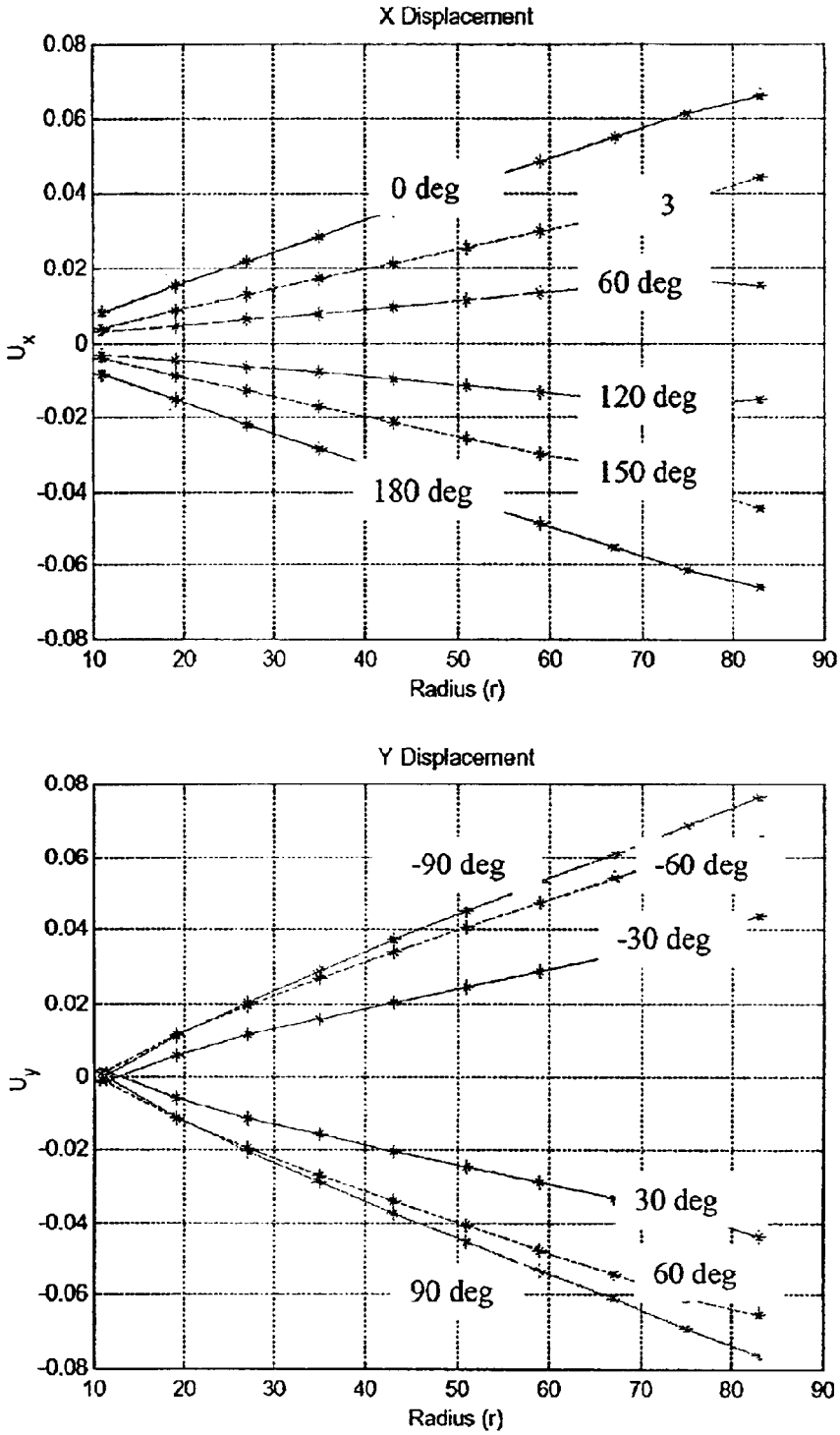
Fig. 17 Boundary Element model for vertical well with fracture: Internal displacements

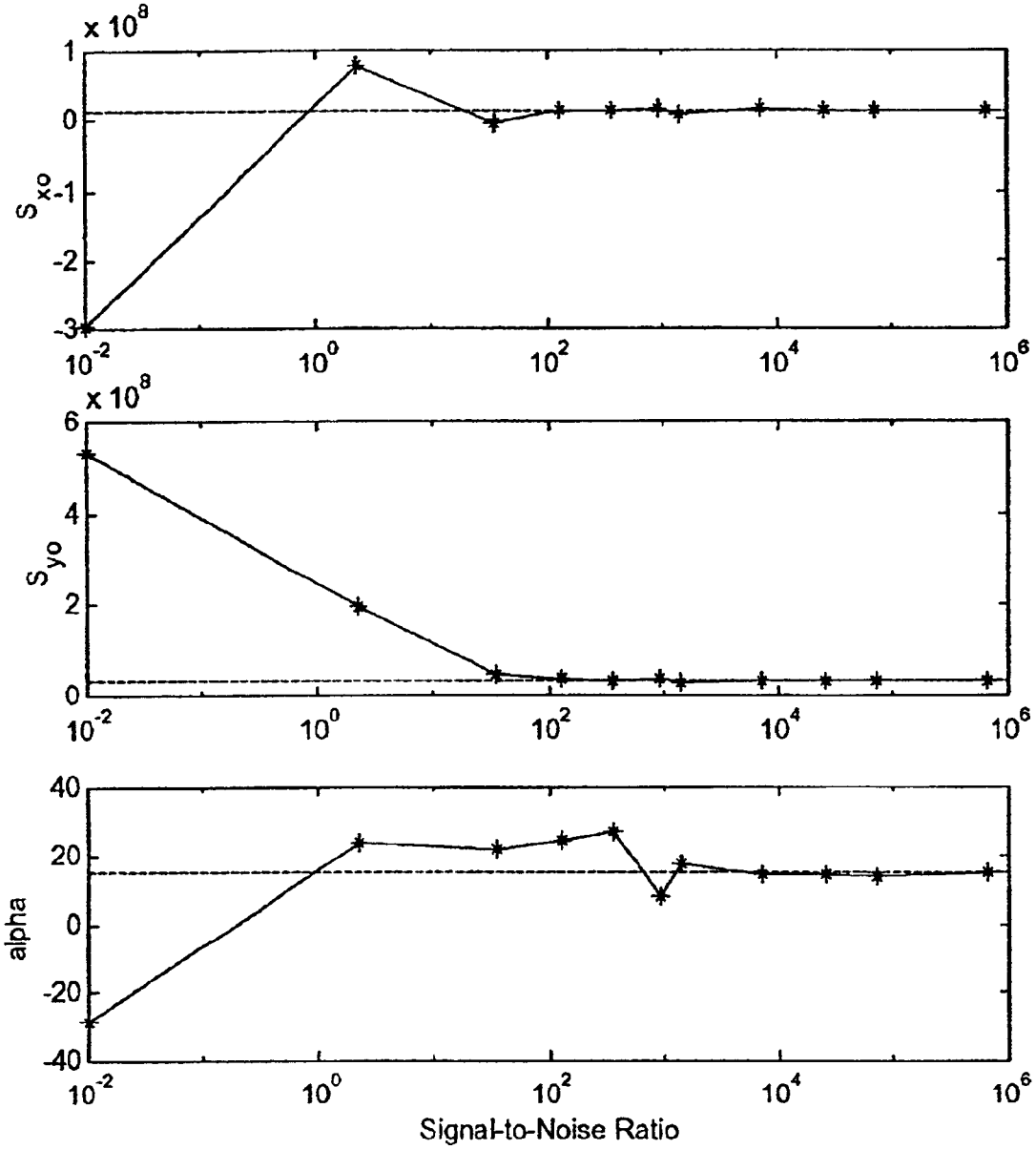
Fig. 18 Effect of noise on estimated parameters

Table I Simulation parameters

| Parameter | Value |
|---|---|
| $\nu_1$ | 0.10 |
| $\nu_2$ | 0.25 |
| $E_1$ | $1.0 \times 10^{10}$ Pa |
| $E_2$ | $2.0 \times 10^{10}$ Pa |
| $R_w$ | 1 m |
| $R_{mid}$ | 2 m |

Fig. 19B Radial stress profile for one-dimensional problem

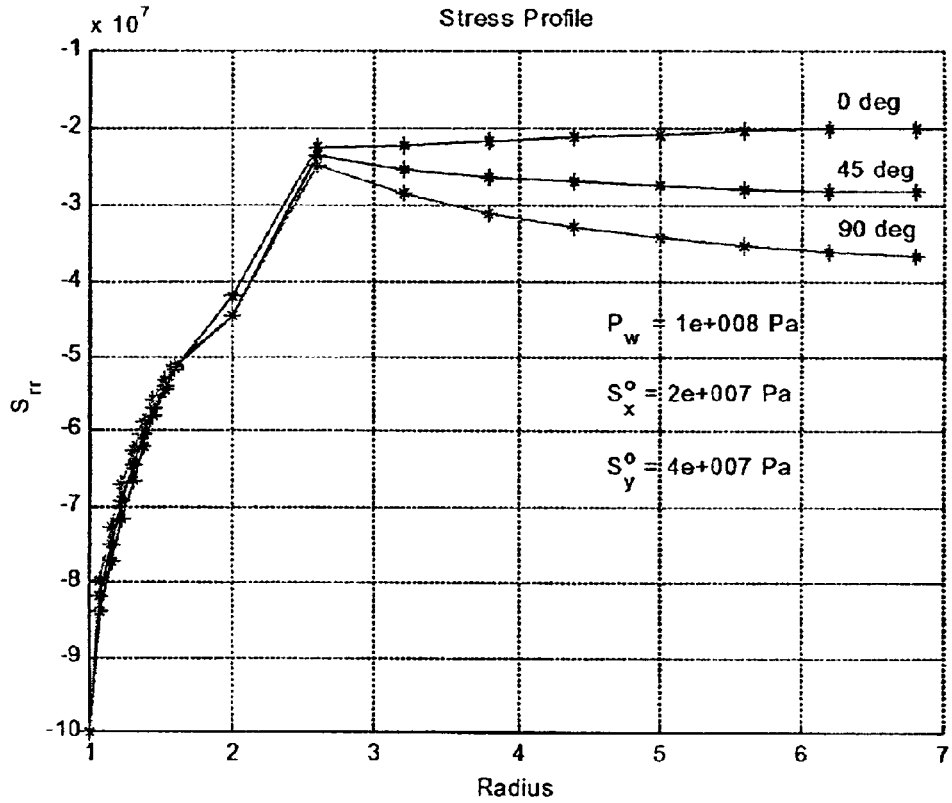
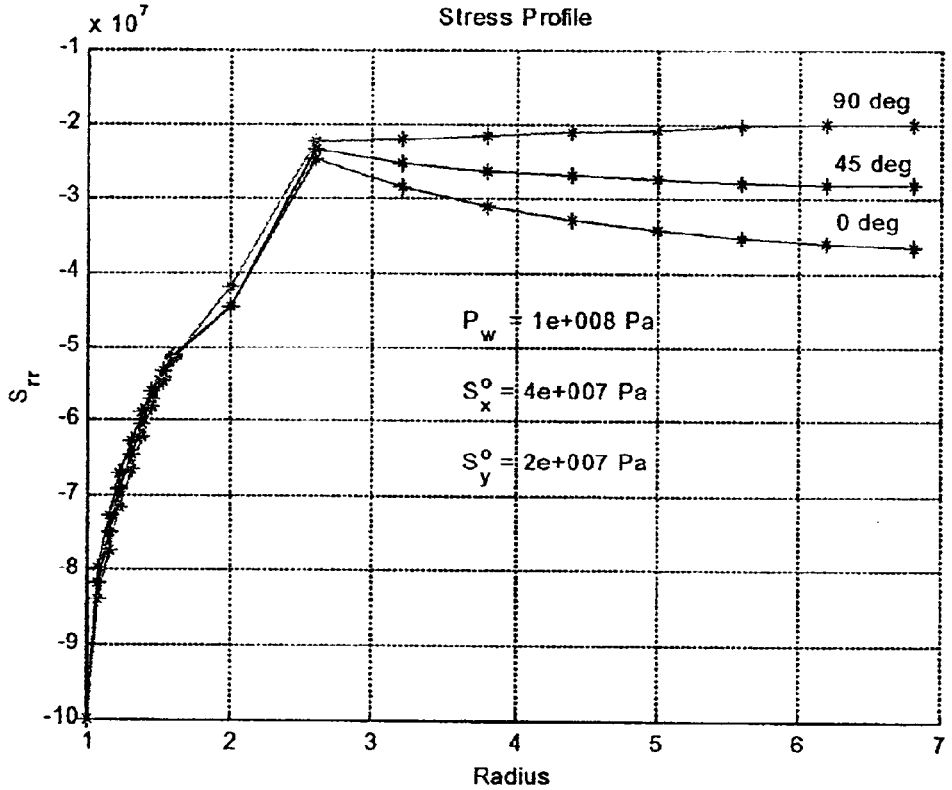
Fig. 20 Multiple zone model: Asymmetric loading

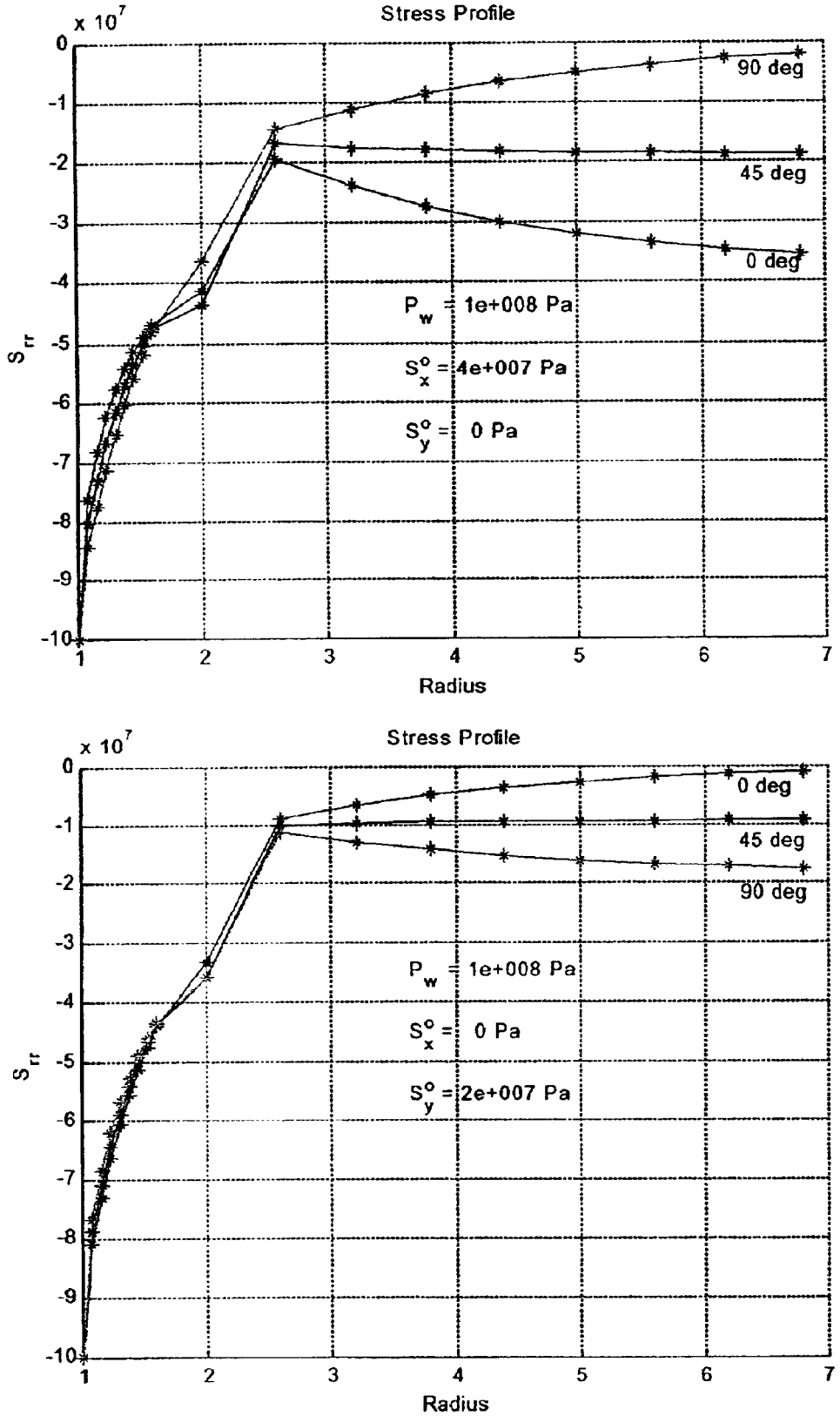
Fig. 21 Multiple zone model: uniaxial loading

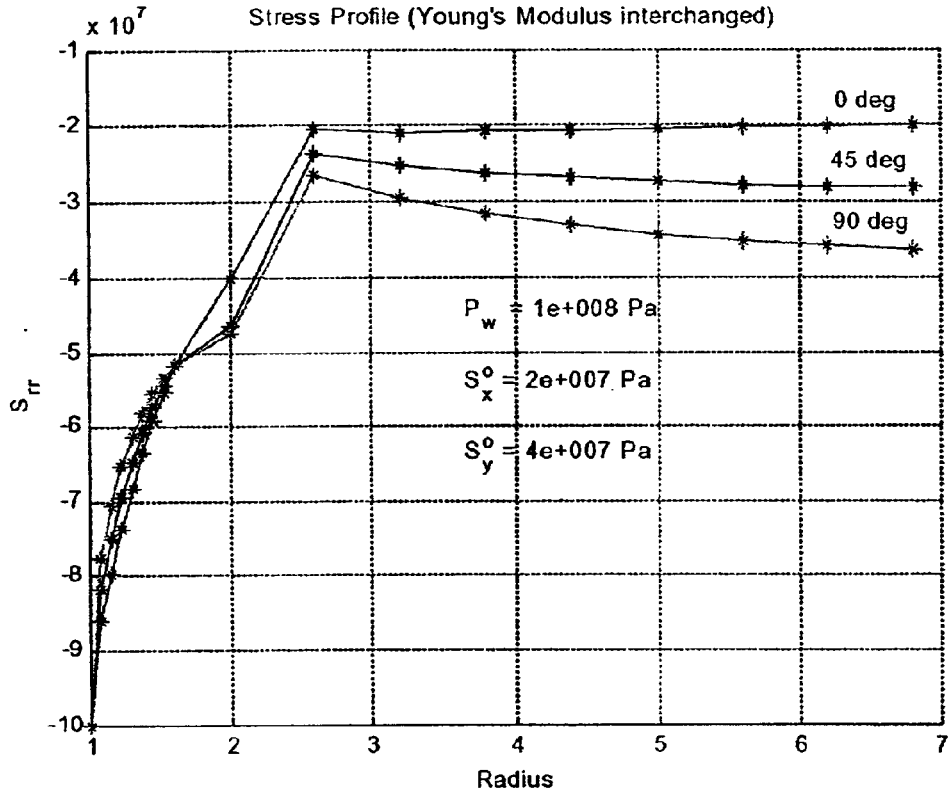
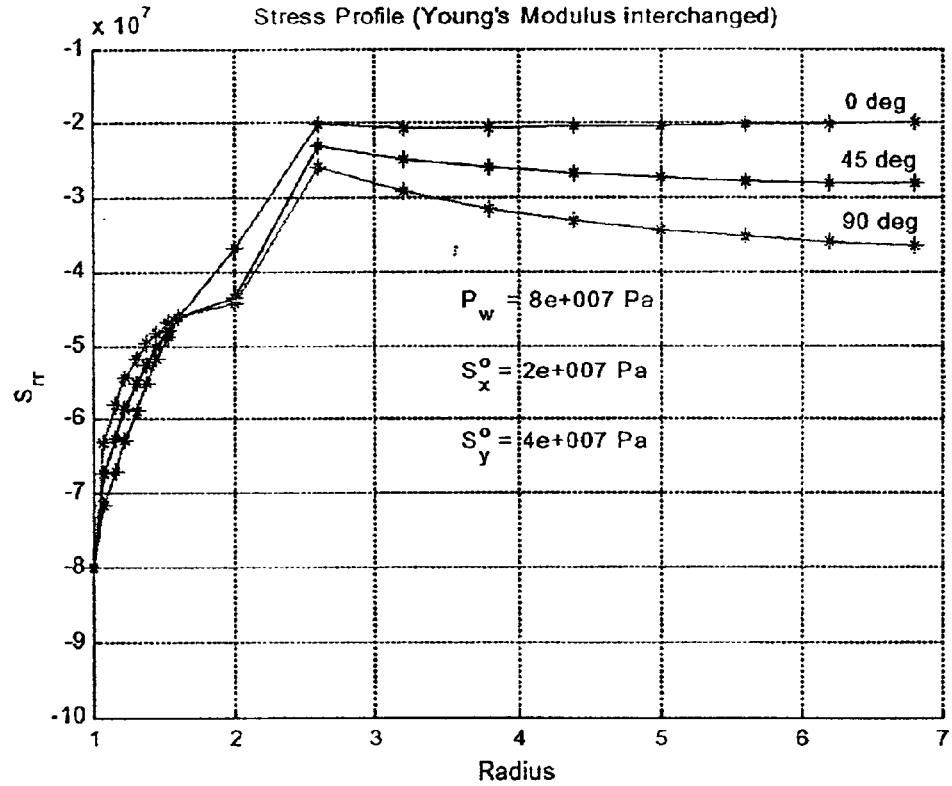
Fig. 22 Multiple zone model: Effect of Young's modulus

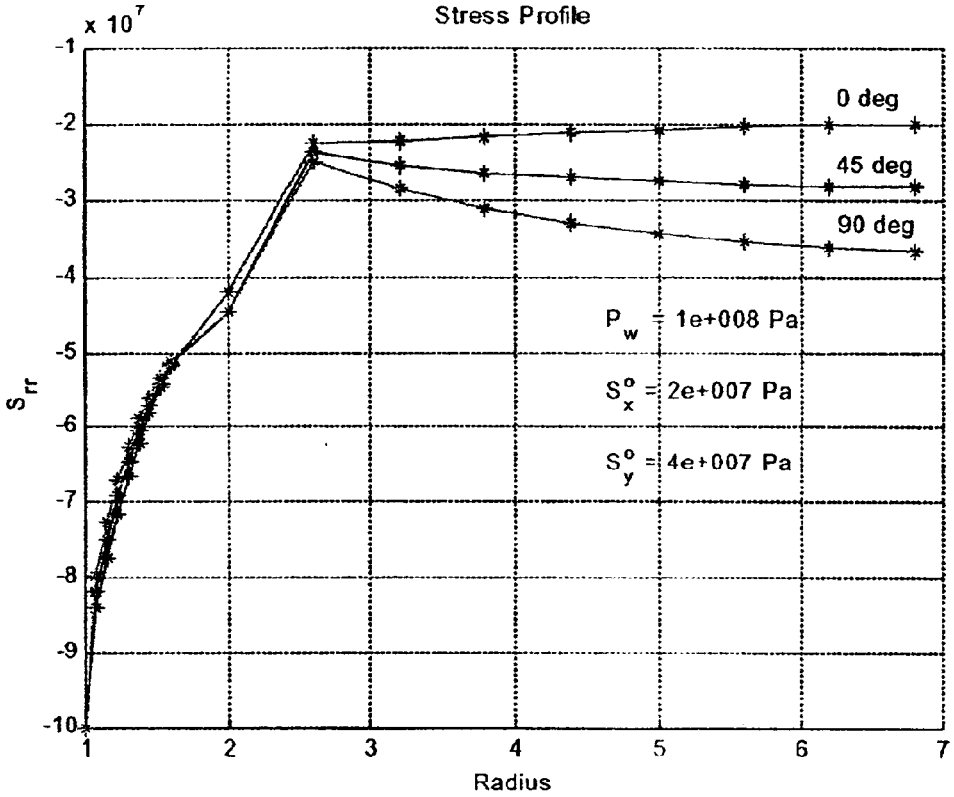
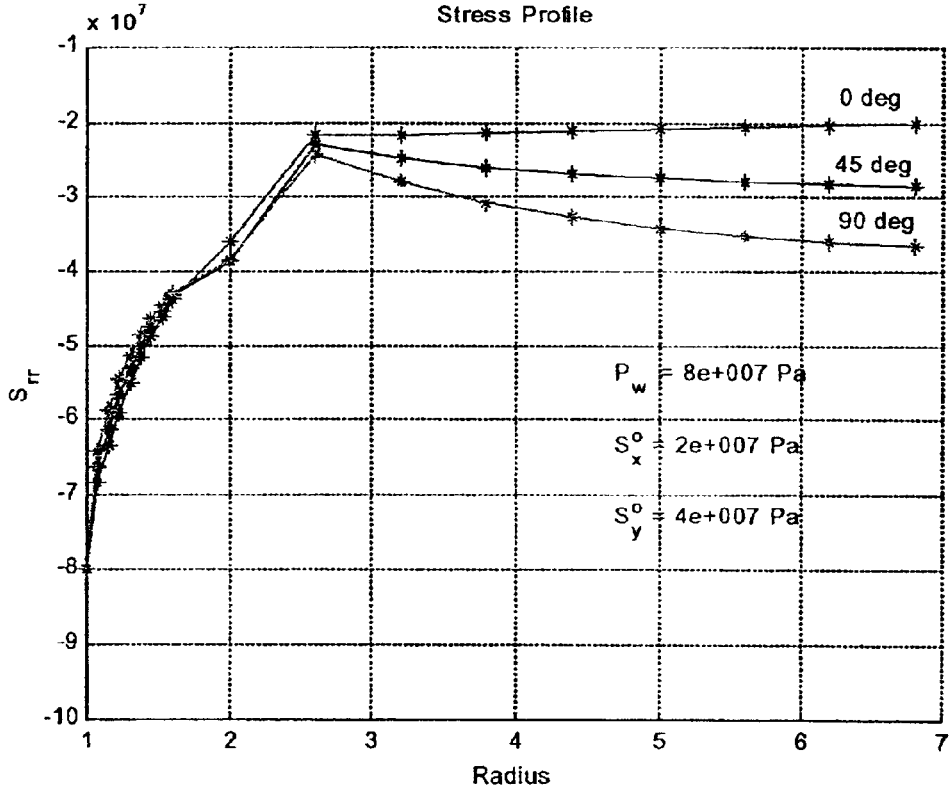
Fig. 23a Multiple zone model: Effect of internal pressure

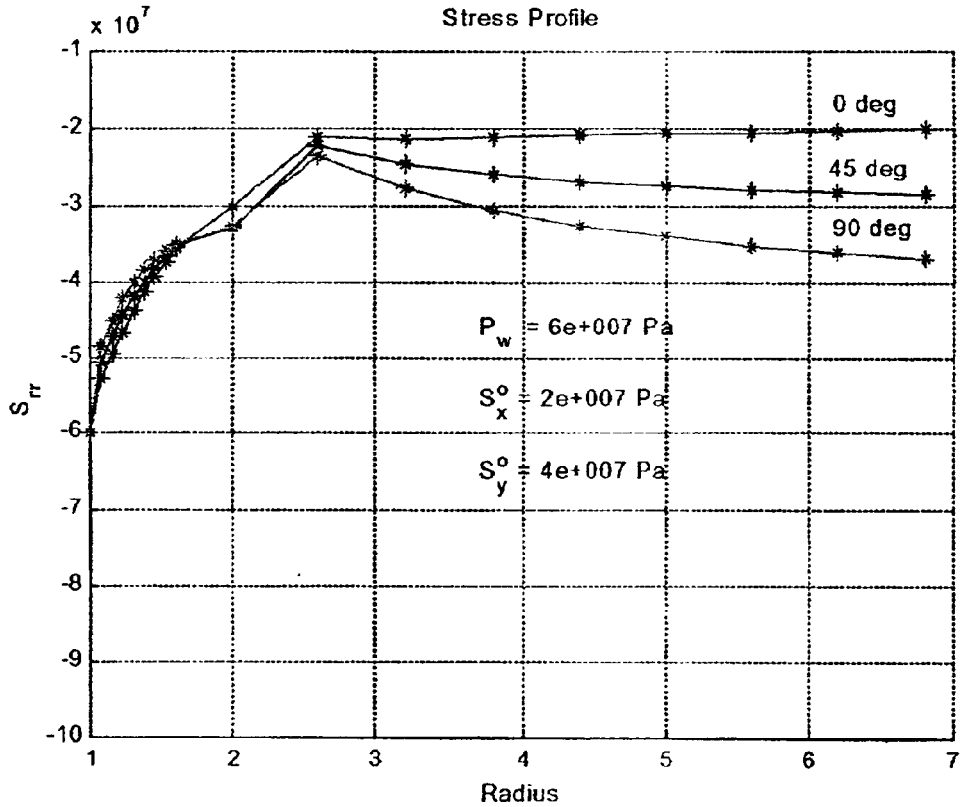
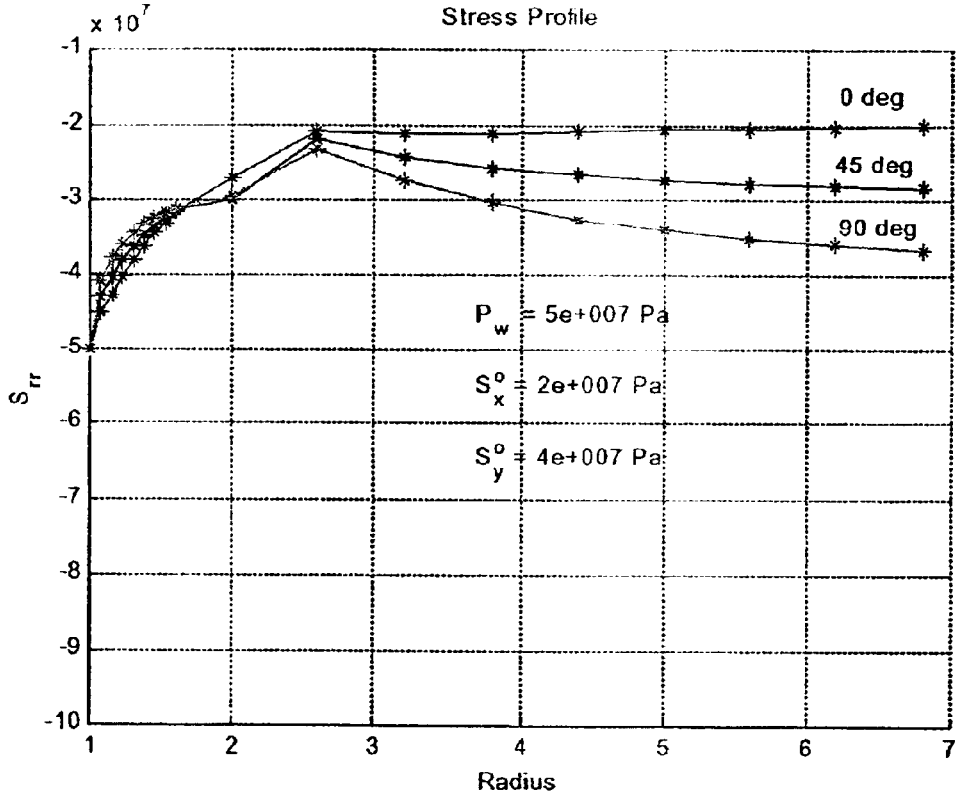
Fig. 23b Multiple zone model: Effect of internal pressure

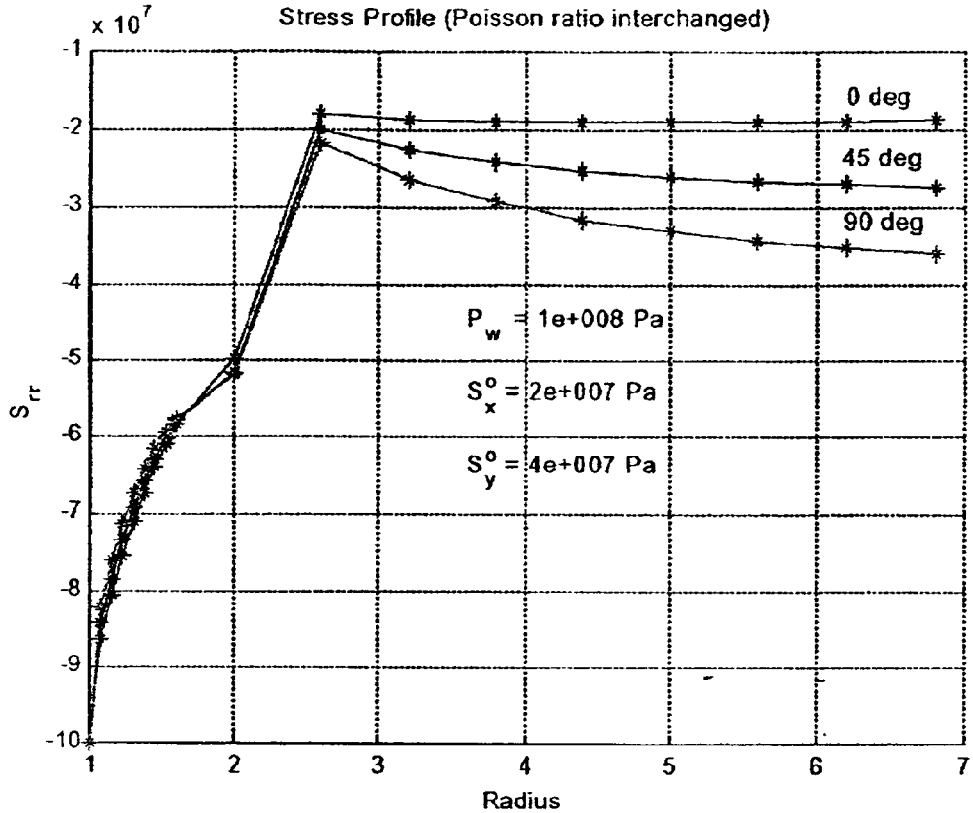
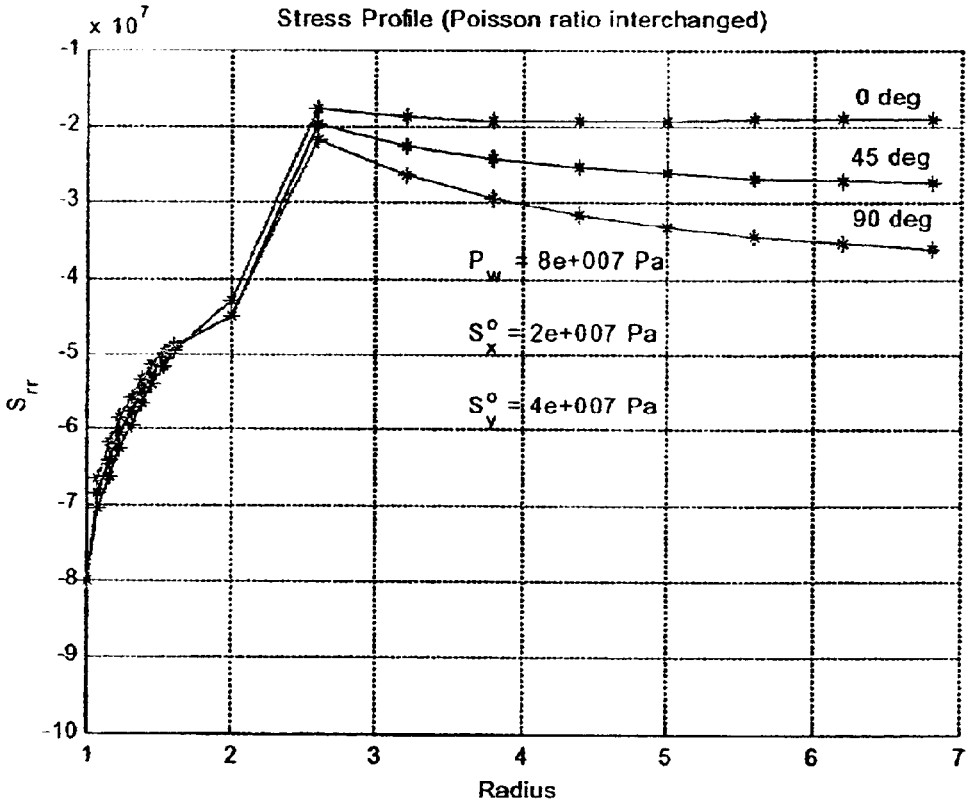
Fig. 24 Multiple zone model: Effect of Poisson ratio

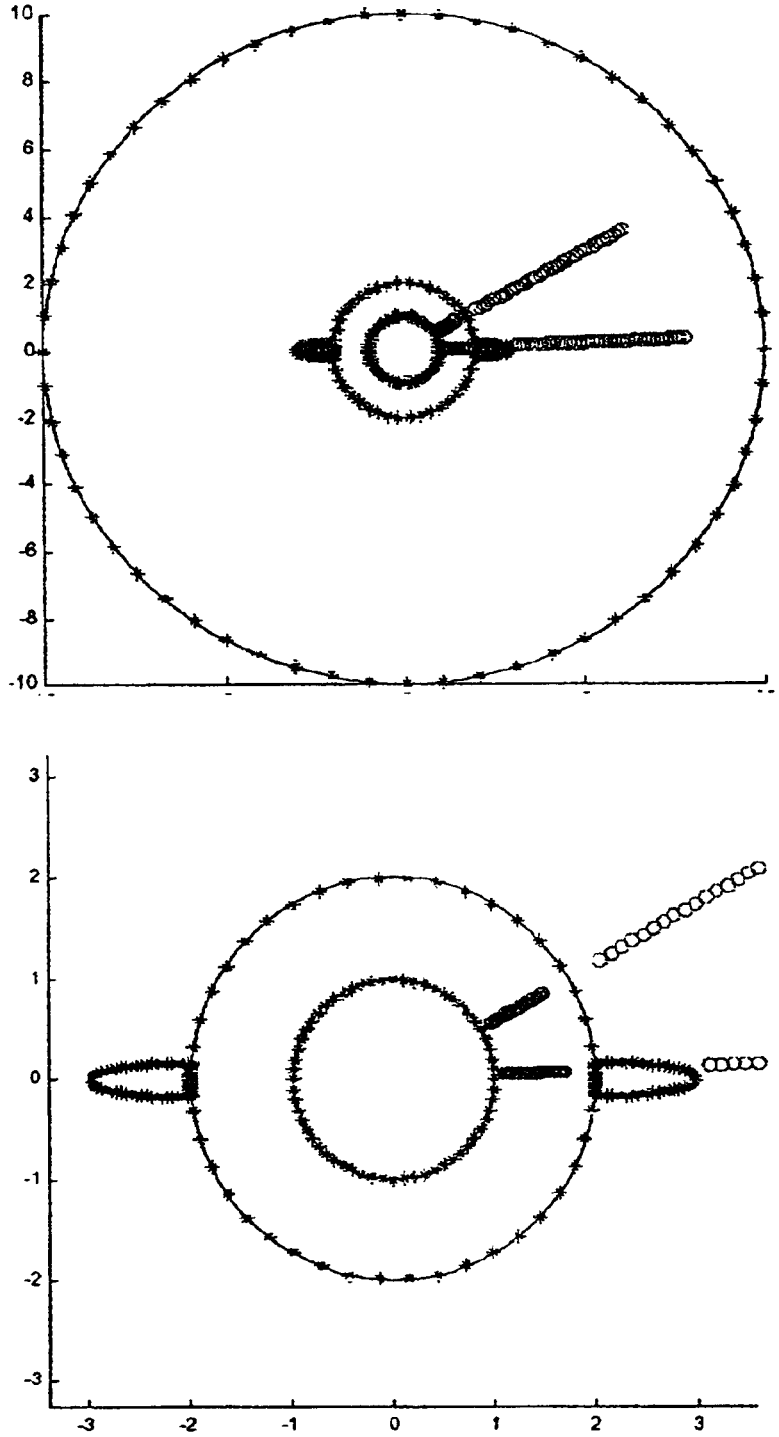
Fig. 25 Multiple zone model: Boundary elements with elliptical fracture

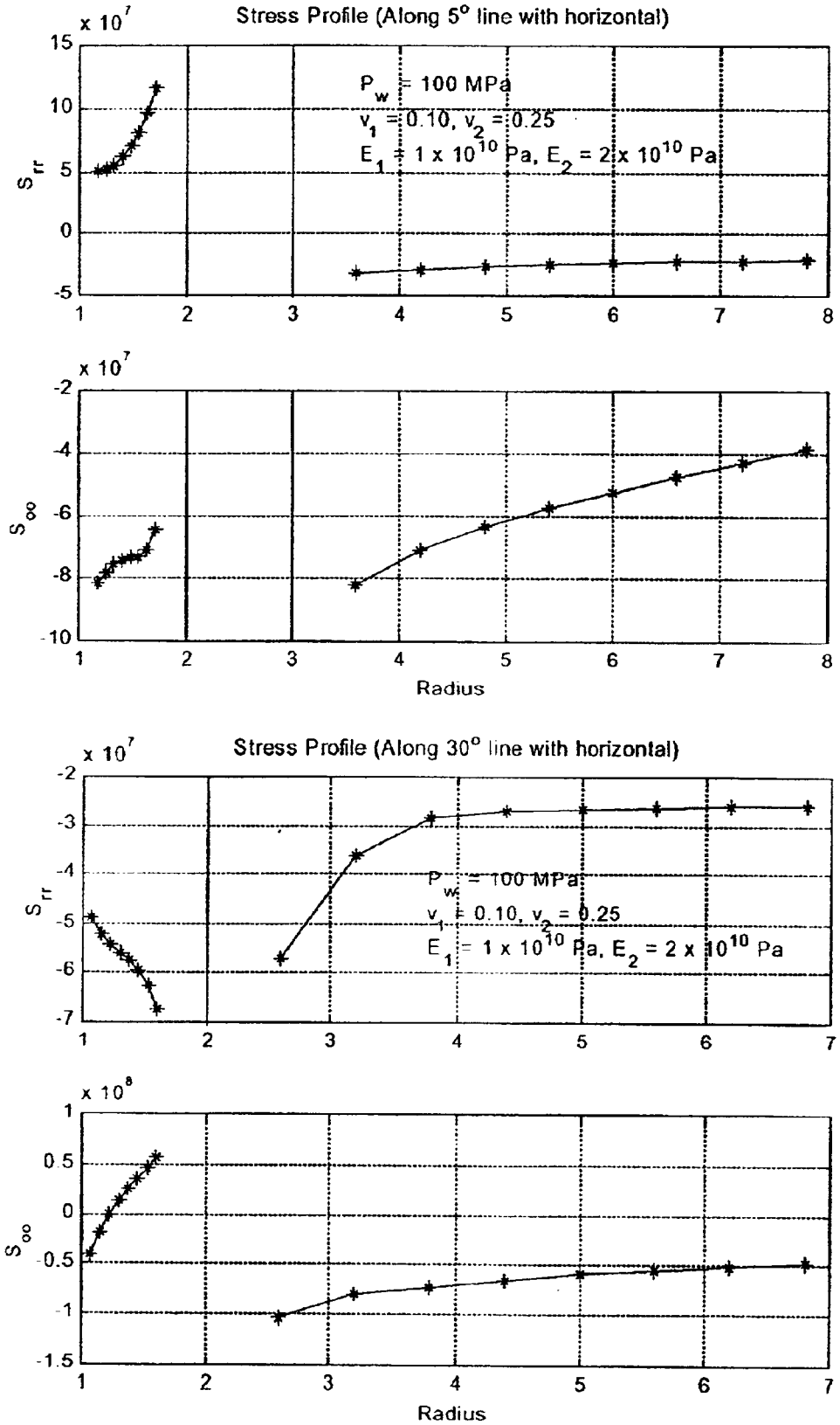
Fig. 26 Multiple zone model: Azimuthal variation

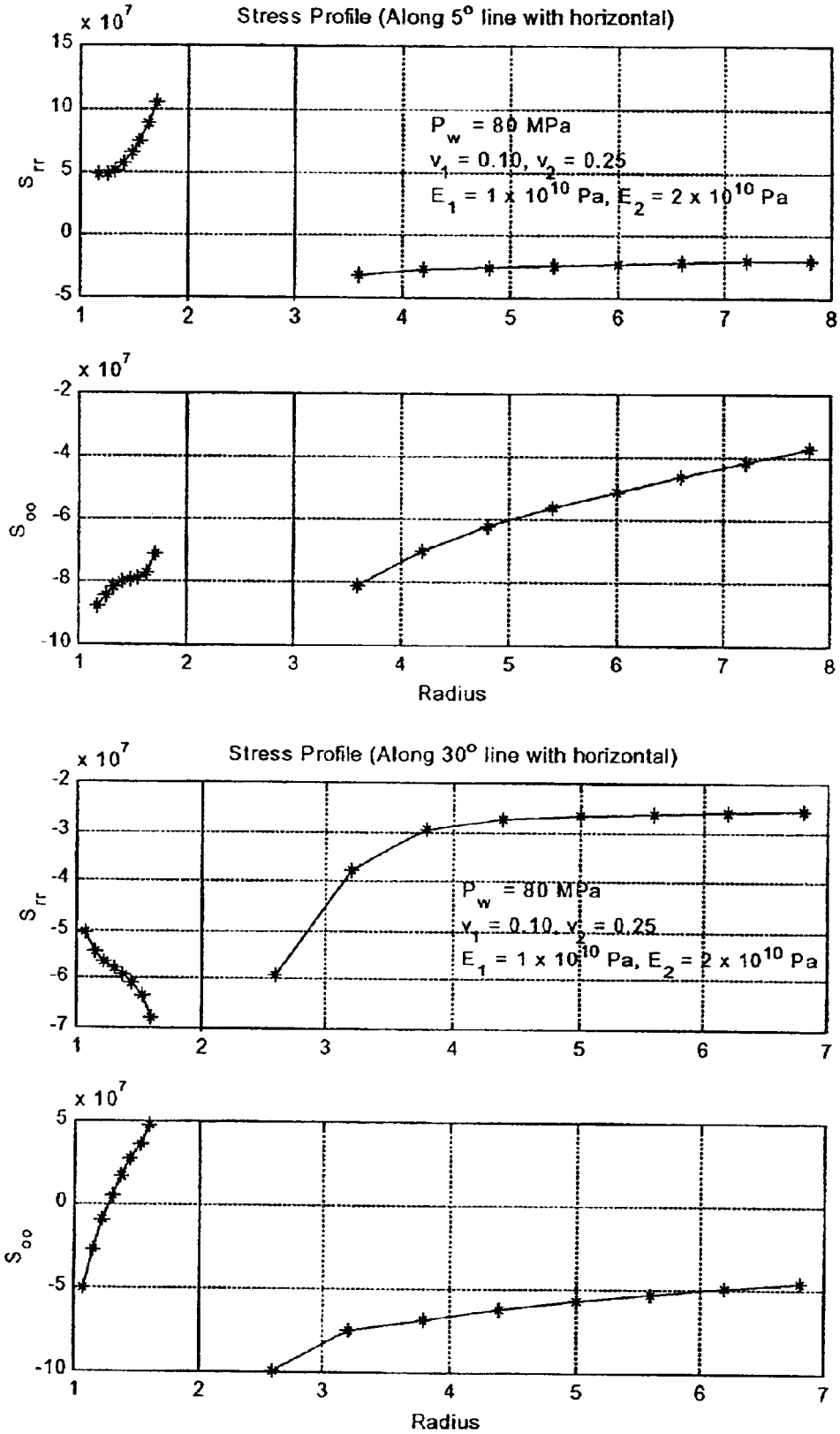
Fig. 27a Multiple zone model: Effect of fracturing pressure

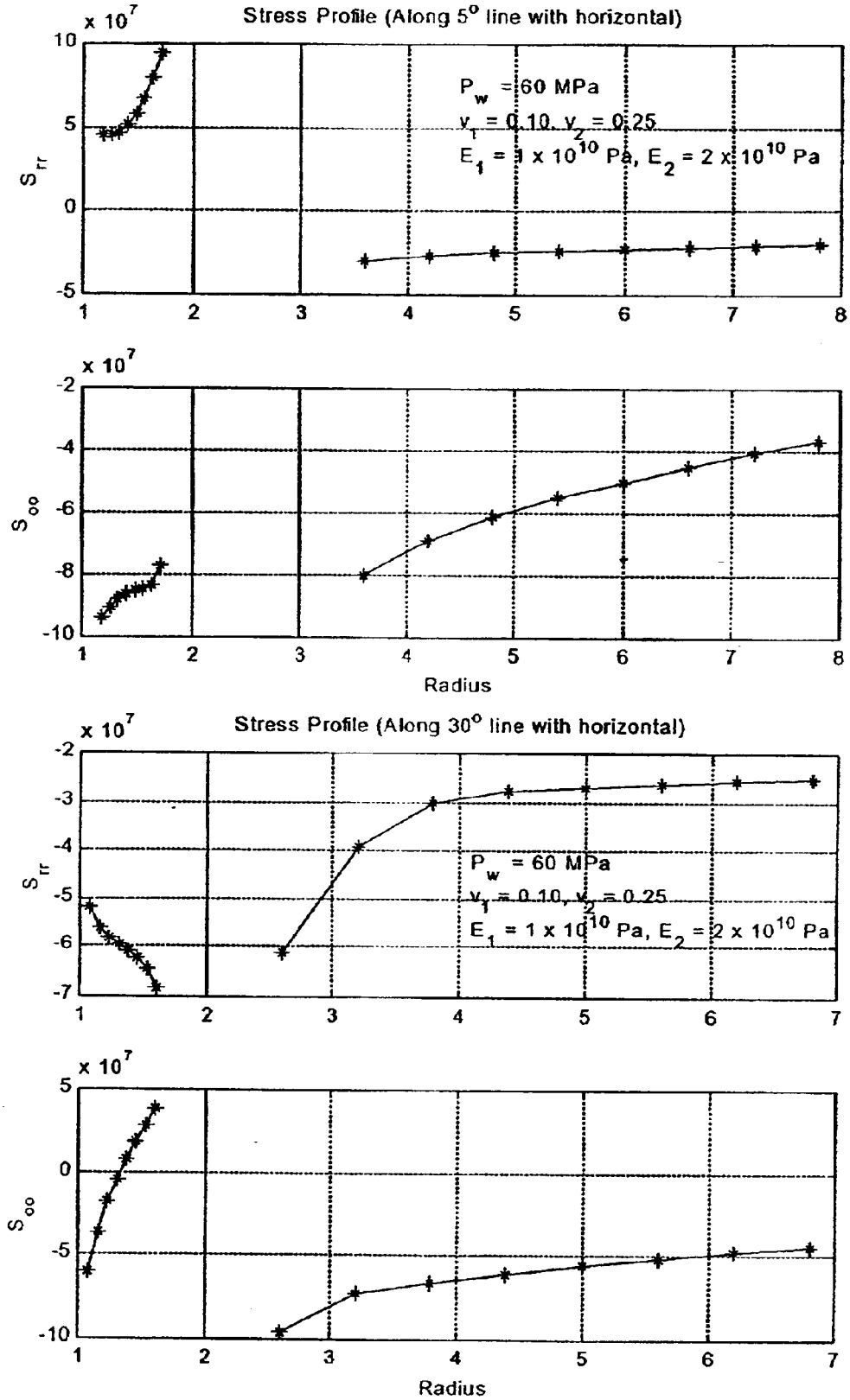
Fig. 27b Multiple zone model: Effect of fracturing pressure

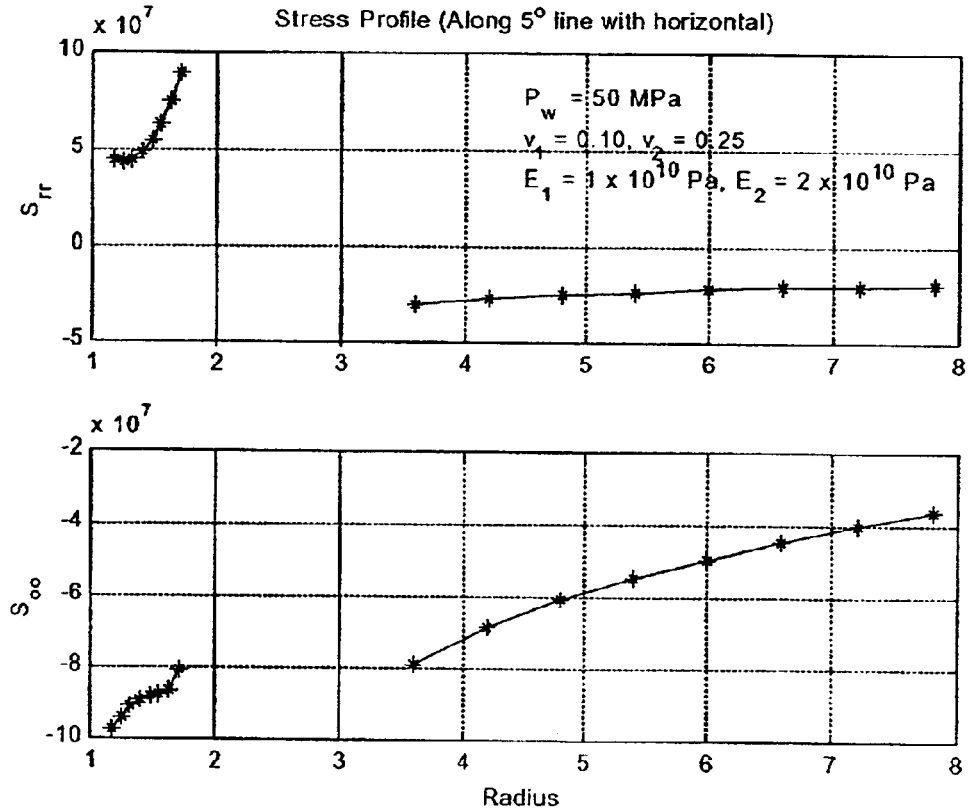
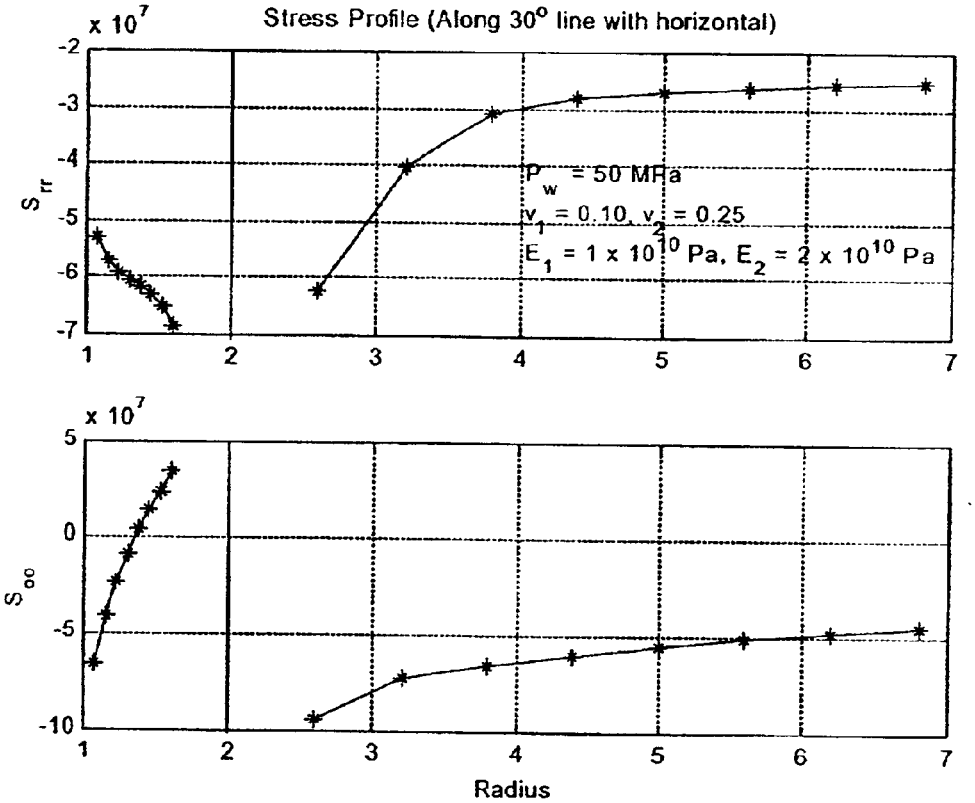
Fig. 27c Multiple zone model: Effect of fracturing pressure

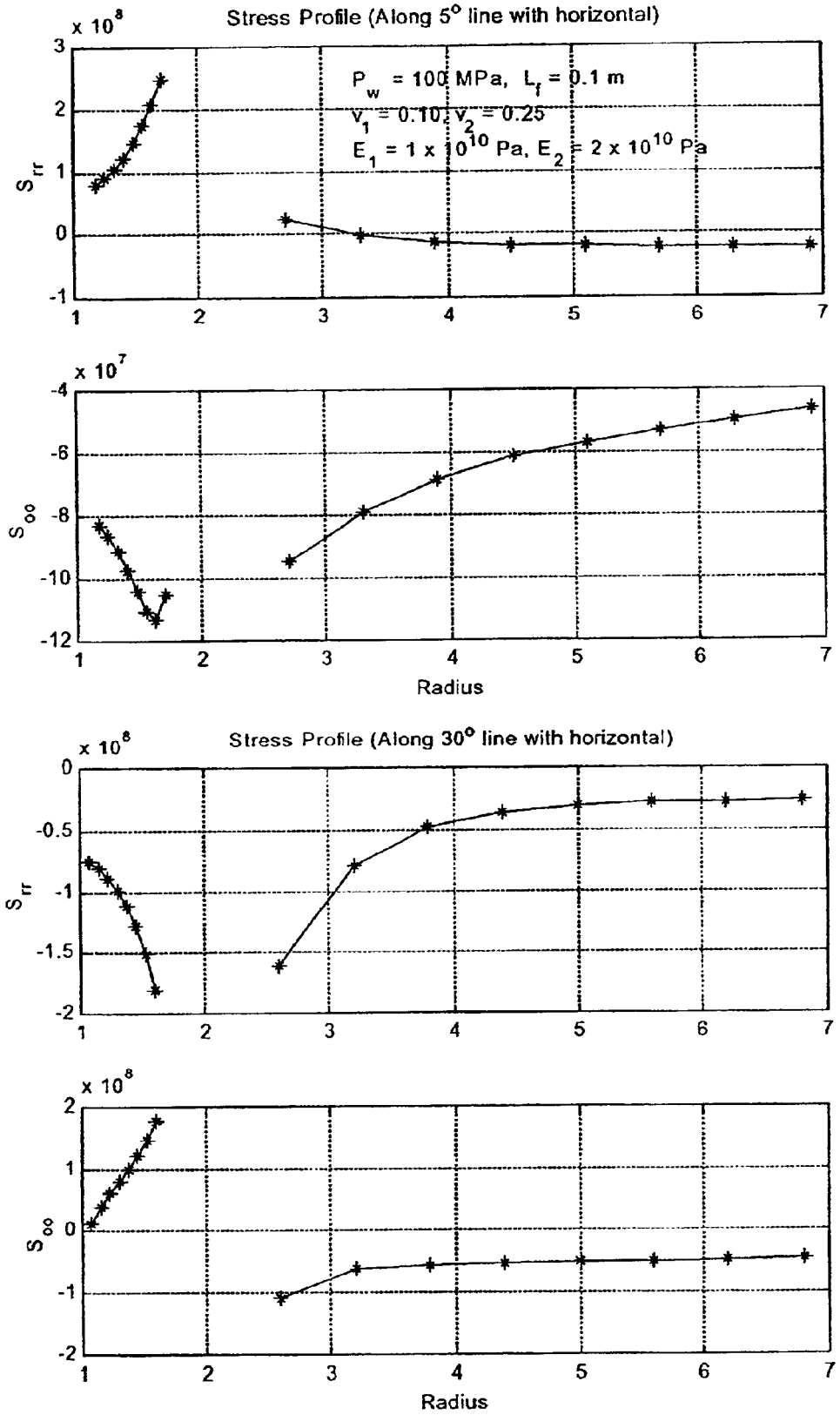
Fig. 28a Multiple zone model: Effect of fracture length

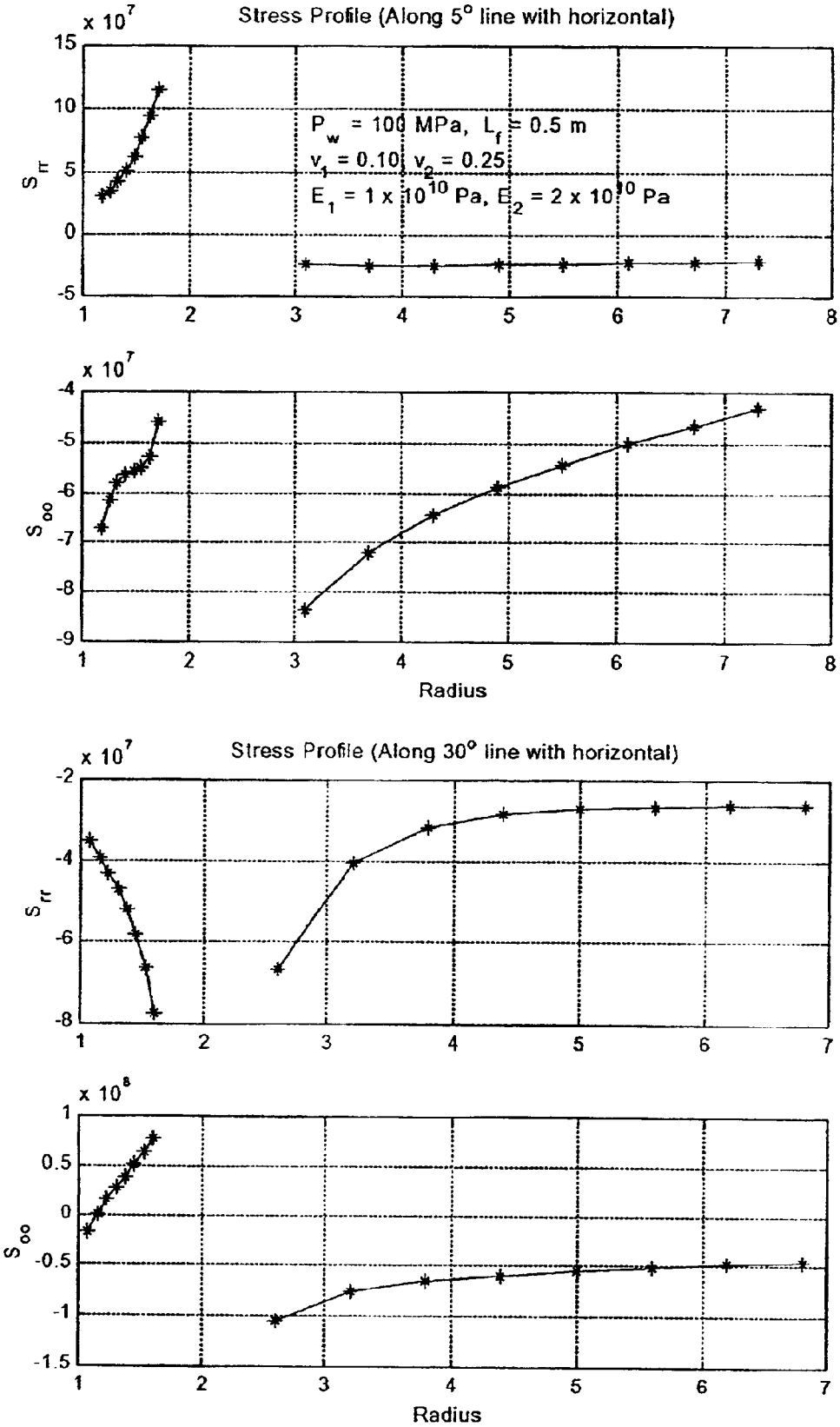
Fig. 28b Multiple zone model: Effect of fracture length

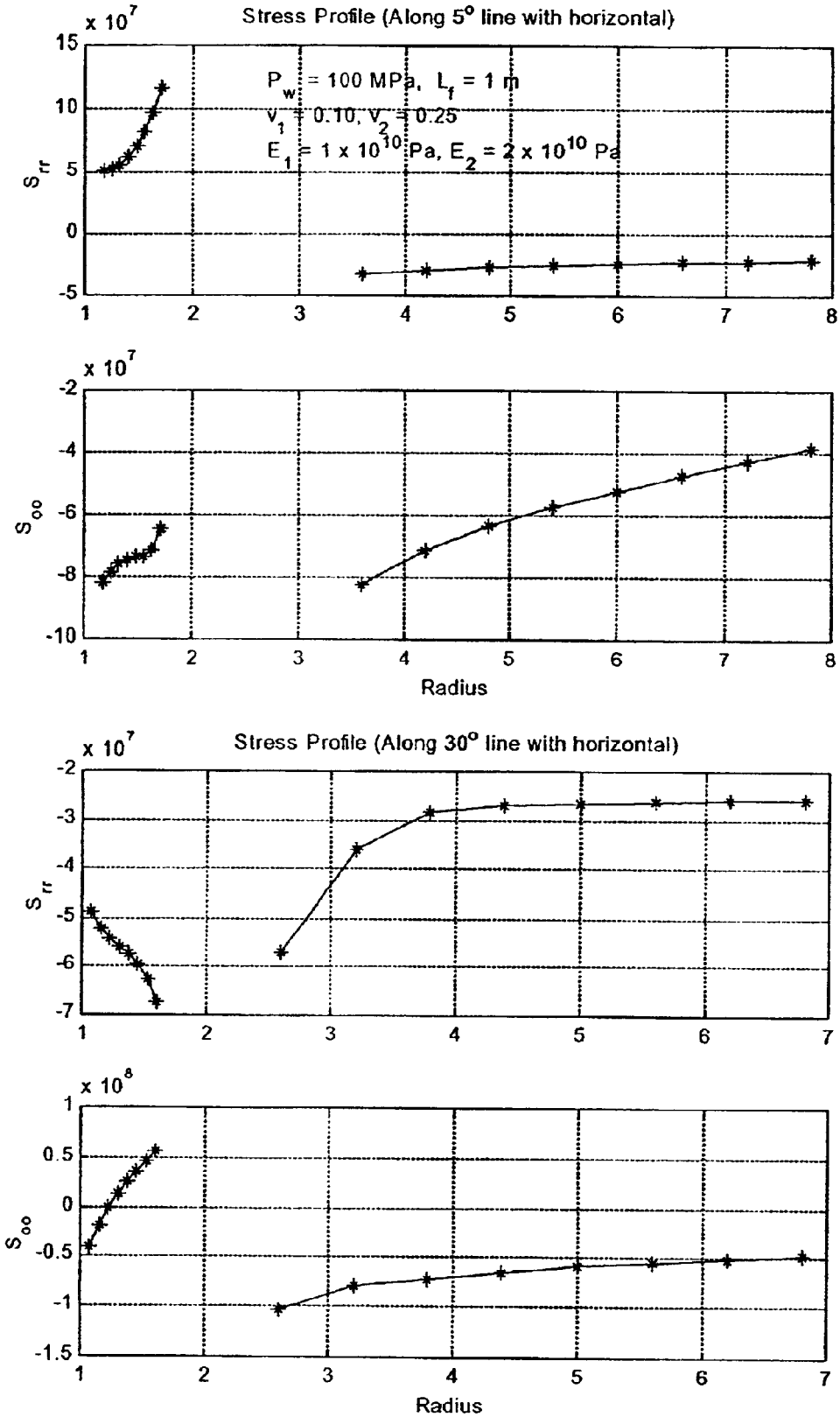
Fig. 28c Multiple zone model: Effect of fracture length

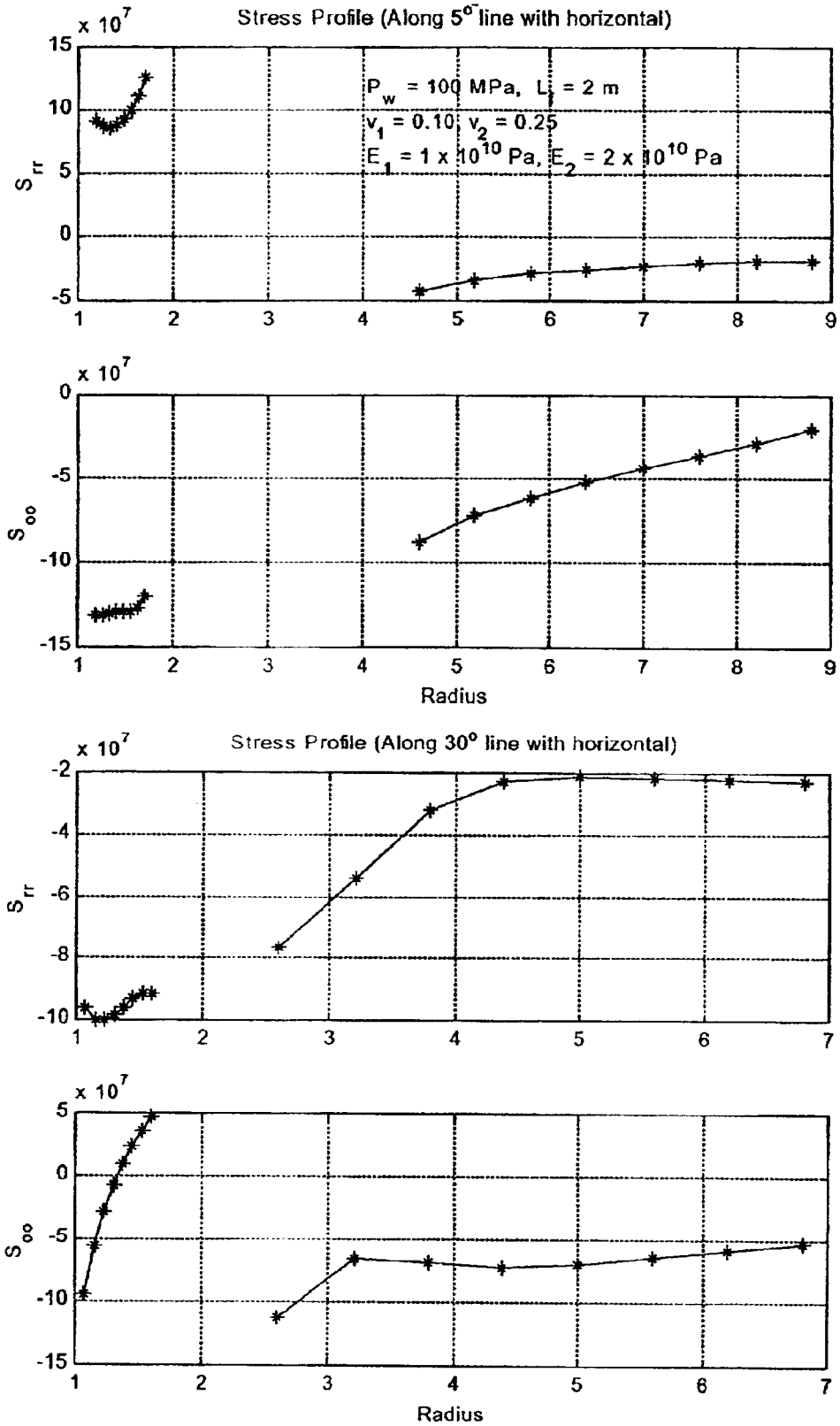
Fig. 28d Multiple zone model: Effect of fracture length

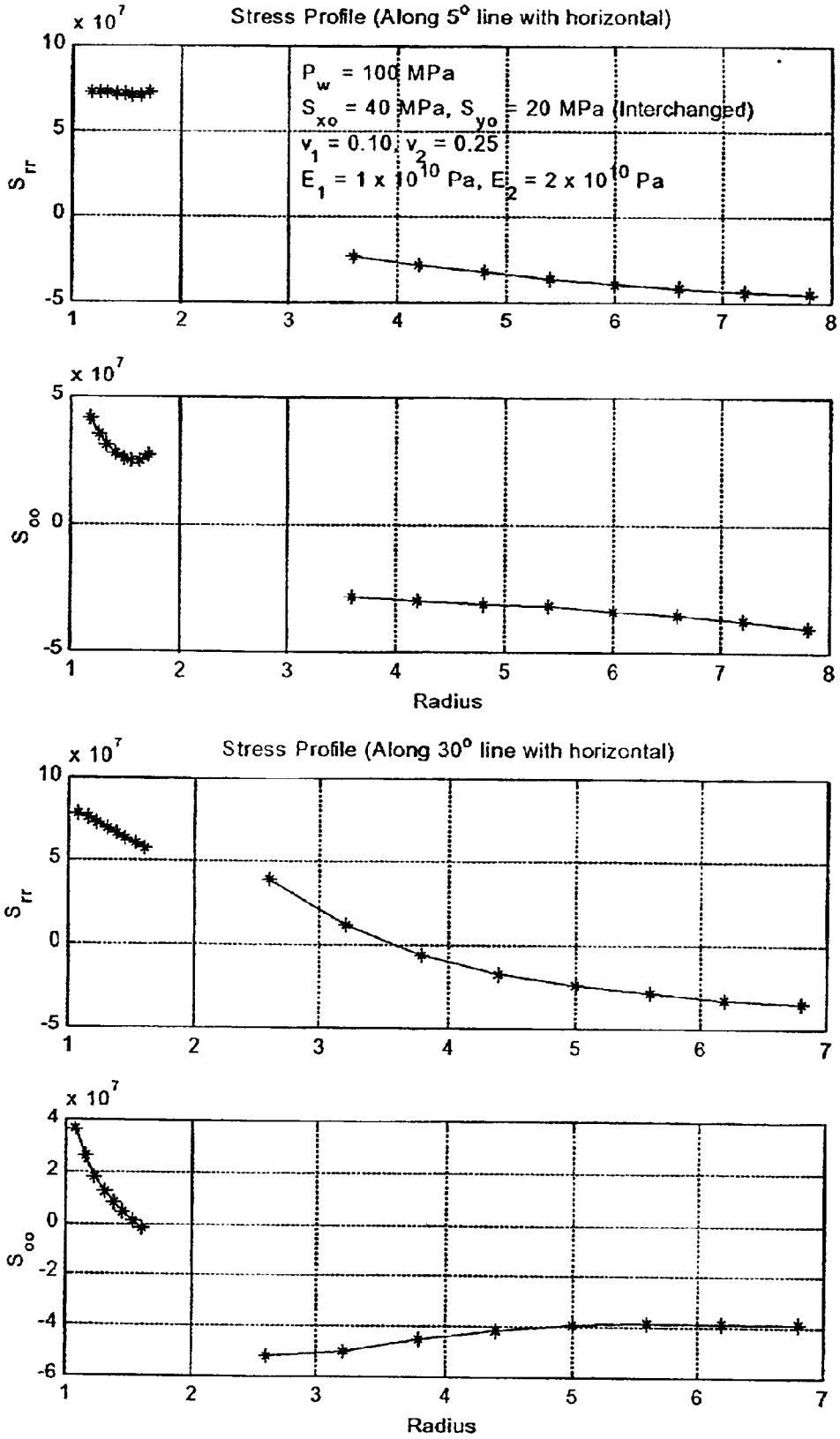
Fig. 29 Multiple zone model: Effect of far-field stress

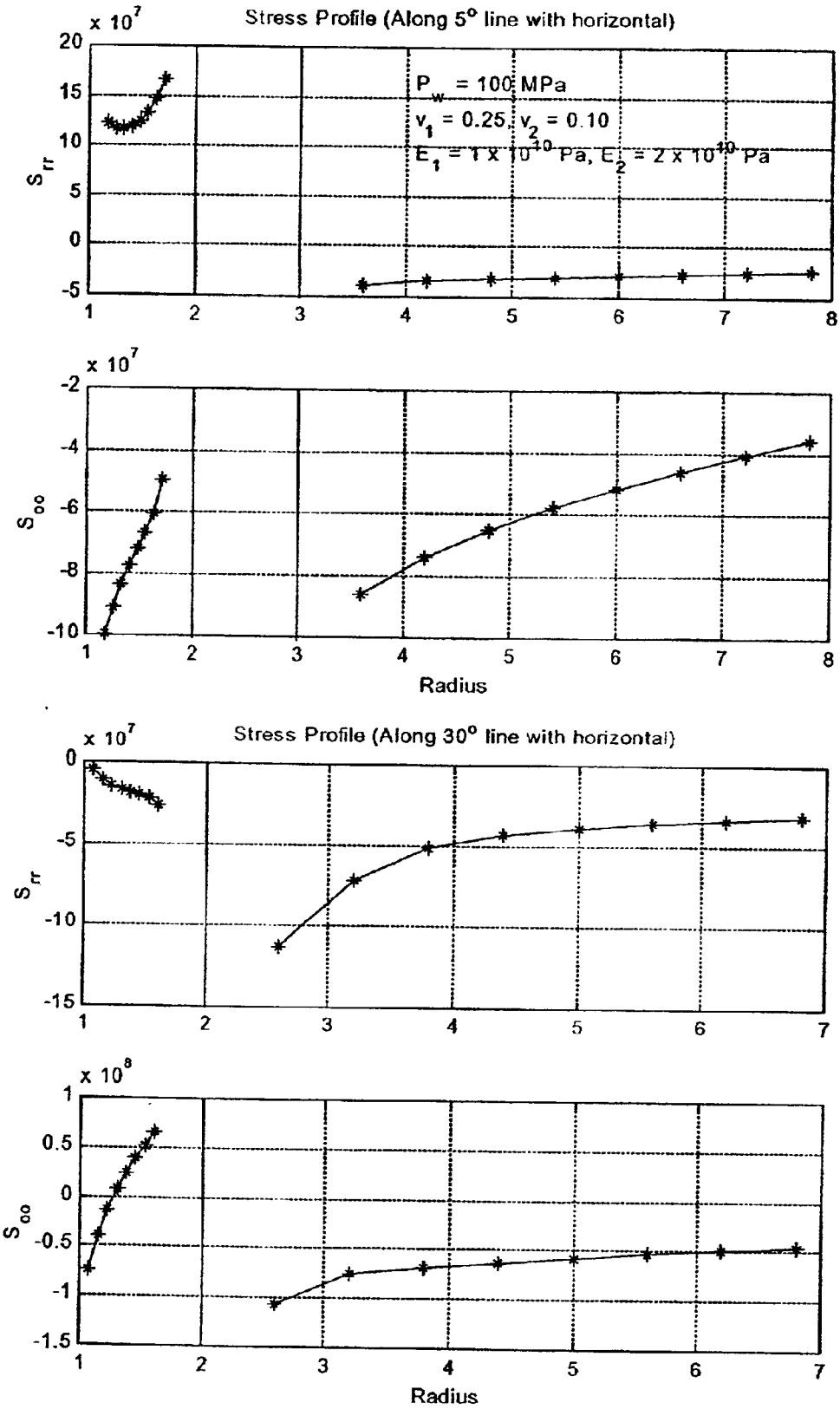
Fig. 30 Multiple zone model: Effect of poisson ratio

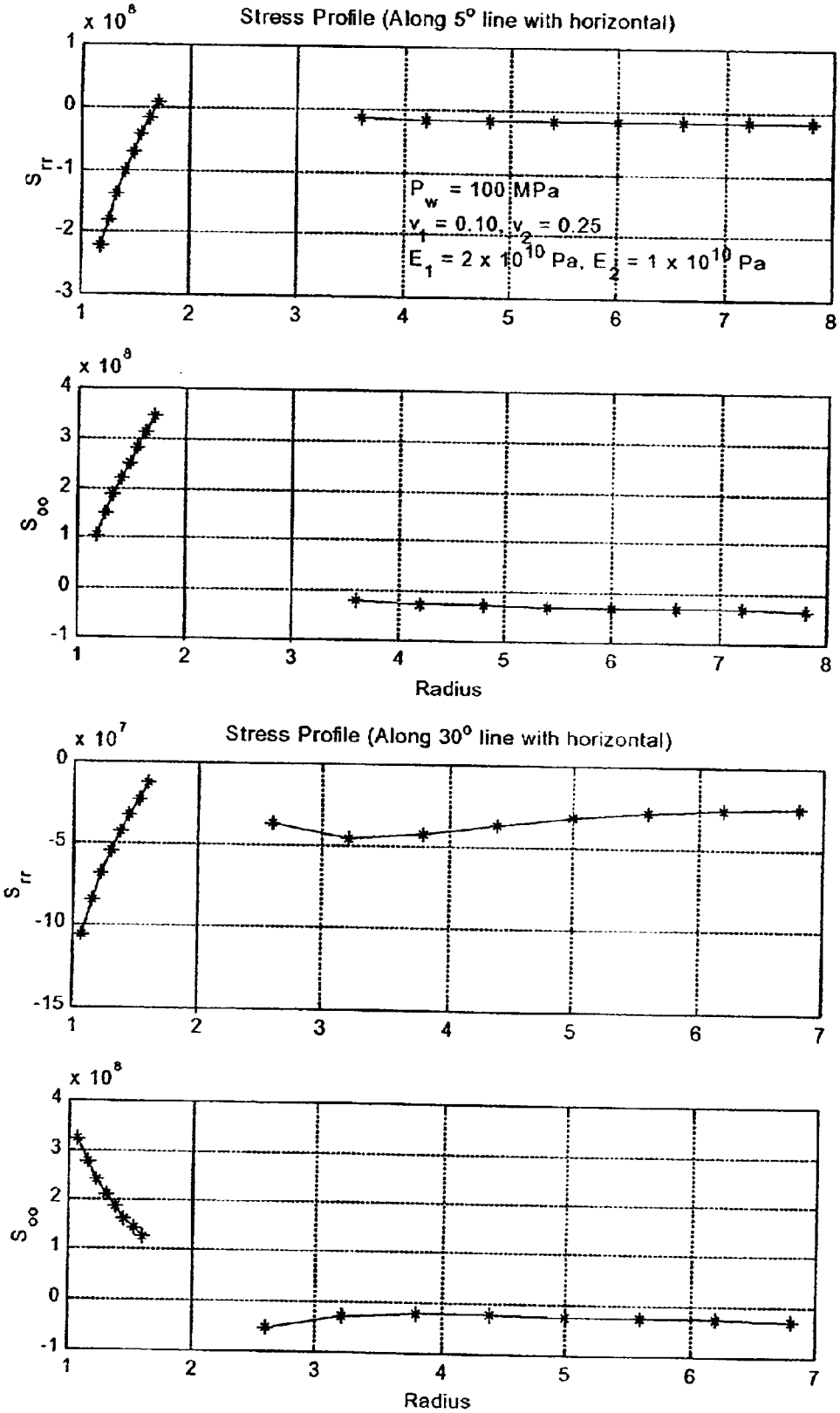
Fig. 31 Multiple zone model: Effect of Young's modulus

SYSTEM AND METHOD FOR STRESS AND STABILITY RELATED MEASUREMENTS IN BOREHOLES

CROSS-REFERENCE TO RELATED APPLICATIONS

Not applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Hydraulic fracture mechanics, by far the most popular well stimulation technique, is often plagued by the uncertainties in field parameters for accurate field implementations. For vertical wells, uncertainties in reservoir parameters, such as far-field stresses, may only affect the size of fractures and do not pose many problems otherwise with respect to the geometry of the resulting fracture. However, for inclined (or deviated) wells, additional problems are introduced that cause a significant difference in the geometry of the fracture, both in size and shape, from its designed course, even in the near-wellbore region. Hence, all estimates of fracture behavior and post-fracture production should be made with the knowledge of the highly irregular fracture profile. More often than not, this is not done, causing considerable departures between expectations and reality.

The near-well stress concentration is affected by a number of factors, which include the far field stresses, the well deviation from both the vertical and a plane of principal stress, and the well completion configuration. In effect, the fracture initiation and, consequently, the resulting fracture geometry are greatly influenced by this stress concentration. Incomplete knowledge of all of these factors causes problems during execution of hydraulic fracturing, such as elevated fracturing pressures and unintended screenouts, because of tortuosity, which adversely affects the post-treatment well performance with especially severe effects in high-permeability formations. The uncertainty in magnitude and orientation of far-field principal stresses causes many of the unexplained perturbations in near-wellbore fracture profiles.

The far-field stresses, which are caused by overburden and tectonic phenomena, are supplanted by a new set of stresses when a borehole is drilled. This near-wellbore in situ stress field, in the presence of an arbitrarily inclined borehole, is dictated by the equilibrium equations and depends on the far-field stresses. Stress values are directly related to the state of strains through constitutive equations (elastic, plastic, etc.). When a hydraulic fracture is created at a borehole, the fracture initiation point is important to the fracture propagation, which, in turn, depends on the state of stress around the well. As a result, the presence of the fracture in the formation now redistributes the stresses from their original values without the fracture. In principle, if all of the required reservoir data are known, then the exact fracture profile can be predicted. However, in reality, uncertainty frequently is associated with the reservoir parameters, such as the principal stress orientations and, especially, the magnitude of the intermediate stress. An important consequence is that the resulting fracture geometry will not match its design. More important, in high-permeability fracturing, there is a compelling need to align the well, perforations, and the fracture to prevent or reduce very detrimental tortuosity.

For an open-hole completion, the problem has been studied previously and reported in P. Valko and M. J. Economides, "Hydraulic Fracture Mechanics," Wiley, West Sussex, 1995. There are predictive models to evaluate both the fracture initiation pressure and the near-well fracture tortuosity, given the far-field stresses and all the angles that can describe the well position and the fracture initiation point. However, when a fracture is introduced into the formation, no closed form analytical solution is available, and numerical models must be relied on to compute the induced stress profile. Typically, finite element models are used predominantly in such solid mechanics applications.

In many cases, hydraulic fracturing may be performed on a completed well having a casing and sheath. The choice of sheath material, such as foamed cement or neat cement, may affect the fracture geometry significantly due to its material properties. Also, the presence of multiple zones may have other influences in the near-well zone, such as on fracture initiation and fracturing pressure. During hydraulic fracturing of a cemented well, for example, internally pressurized wellbores cause the casing to expand, which induces a tensile stress in the surrounding continuous cement sheath. As a result, the fracture initiation is a function of the cement's tensile strength and the tensile stresses induced within the cement sheath. However, the effect of the far-field stresses should be included in the field, which is almost always asymmetrical in nature. In effect, both tensile and compressive stresses may act on portions of the cement sheath, thereby making some portions more vulnerable to fracture initiation.

As mentioned, finite element models predominate in such applications. However, finite element modeling can become inefficient and cumbersome for many classes of problems, including fracture mechanics. Finite element models are cumbersome when it comes to complex geometry, in terms of their size, reusability with minor changes, and resources required. An alternative approach, the boundary integral equation method (BIEM), was proposed in the 1950's for fluid flow applications, and applied in the late 1960's to mechanical analysis. See, for example, C. A. Brebbia, "The Boundary Element Method for Engineers," Pentech Press, Plymouth, 1978. The boundary element method (BEM) emerged as a more generally applicable technique during the 1970's, and has been developed substantially in the following years. See, for example, J. Trevelyan, "Boundary Elements for Engineers—Theory and Applications," Computational Mechanics Publications, Southampton and Boston, 1994. Boundary element techniques are far superior to finite element models, due to ease of use, accuracy, flexibility, and computational speed.

The boundary element method is a numerical technique for analyzing the response of engineering structures when subjected to some kind of "loading." The main feature of BEM is that the governing equations are reduced to surface or boundary integrals only, with all volume integrals removed by mathematical manipulation. Because only surface integrals remain, only surface elements are needed to perform the required integration. So, the boundary elements needed for a 3D (three-dimensional) component are quadrilateral or triangular surface elements covering the surface area of the component. Even simpler, the boundary elements for 2D (two-dimensional) and axisymmetric problems are line segments tracing the outline of the component.

The simplicity of a BEM model means that much detail can be included without complicating the modeling process. In particular, cylindrical holes, such as petroleum wells, can be modeled very quickly, where there is no connection between a hole and the outer surface. Boundary elements also allow analysis of problems that would overwhelm finite element models with too many elements. The system matrix for boundary elements is often fully populated (i.e., dense) and non-symmetrical, but is of significantly smaller dimension than a banded finite element global stiffness matrix.

Because boundary elements are simply lines for 2D and axisymmetric problems, there needs to be a convention used for determining which side of an element is the free surface and which side is inside the material. It is most convenient to use the direction of definition of the element connectivity as the indicator of this orientation. Under this convention, as will be appreciated by those skilled in the art, if the direction of all elements in the model were reversed, we would be modeling the entire infinite universe surrounding a void shaped like the boundary element mesh. In petroleum well applications, these boundary elements are very useful since a few elements can model the problem very accurately where several thousand finite elements likely would be necessary.

The boundary elements are located only on the surface of the component, as are the nodes of the elements. This means that the locations at which the boundary element results are found are only on the surface of the component. It is possible to extract the results for any internal point(s) inside the material simply from the solution over the boundary. The results are not just found by extrapolation, but by using an accurate integral equation technique very similar to that used for the solutions over the boundary elements.

Boundary elements also allow us to define models consisting of a set of sub-models, or zones. Zones are boundary element models in their own right, being closed regions bounded by a set of elements. They share a common set of elements with the adjacent zones. These "interface" elements, which are completely within the material and not on the surface, form the connectivity between the various zones. This zone approach can be employed when a component consists of two or different materials, when components have high aspect ratio, when elements become close together across a narrow gap leading to inaccurate results, or when computational efficiency needs to be improved.

This boundary element method eliminates the necessity for nested iterative algorithms, which are unavoidable when domain integral methods, such as finite difference methods and finite element methods, are used. Using BEM, it is easier to change a model quickly to reflect design changes or to try different design options. The boundary element method is highly accurate, because it makes approximations only on the surface area of the component instead of throughout its entire volume.

Forward Model of Fractures from a Given Point if Environmental Conditions Known The solution to the forward problem using well known calculations determines the induced stress concentration at a point for known internal pressure and far-field conditions, with or without fracture. It is quite useful in avoiding highly undesirable situations a priori or in determining the ideal location of a new hydraulic fracture. For a well, the natural boundary conditions are specified in the form of traction at the far-field boundary and internal pressure at the wellbore. Once these are known, the geometry of the fracture can be modeled in the well using the method shown in P. Valko and M. J. Economides, "Hydraulic Fracture Mechanics," Wiley, West Sussex, 1995. A typical conclusion would be that deviated wells are generally far less attractive hydraulic fracture candidates than vertical wells or horizontal wells that follow one of the principal stress directions.

A brief summary of the development of the boundary integral equations for static stress/displacement problems now is presented. The boundary integral equation for elastostatics is derived from Betti's Reciprocal Theorem, as will be appreciated by those skilled in the art. The BEM is then derived as a discrete form of the boundary integral equation. The reciprocal theorem states that, for any two possible loading conditions that are applied independently to a structure such that it remains in equilibrium, the work done by taking the forces from the first load case and the displacements from the second load case is equal to the work done by the forces from the second load case and the displacements from the first load case. For example, if the two loading conditions are called conditions A and B, we can write:

$$\text{Forces}_A \times \text{Displacements}_B = \text{Forces}_B \times \text{Displacements}_A$$

Now consider an arbitrary body shape made of a certain material and subject to certain boundary conditions (e.g., loads, constraints, etc.), as shown in FIG. 1. The volume of the body is denoted V, and its surface is denoted S. The tractions, displacements, and body forces are denoted as t, u and b, respectively. Also, define a complementary problem in which the same geometry is subjected to a different set of loads, as shown in FIG. 2. In this complementary condition, the variables are the tractions t*, the displacements u* and the body forces b*. Using the reciprocal theorem, the work done by the forces in the real load case (t,u,b) and the displacements from the complementary load case (t*,u*,b*) are equated to the work done by forces in the complementary load case and the displacements from the real load case, or $$\int_S t^* \cdot u\,dS + \int_V b^* \cdot u\,dV = \int_S u^* \cdot t\,dS + \int_V u^* \cdot b\,dV.$$

If the body forces in the real load case are ignored, the result is $$\int_S t^* \cdot u\,dS + \int_V b^* \cdot u\,dV = \int_S u^* \cdot t\,dS.$$

It is helpful for the complementary load case to represent a type of point force. The form of the point force is the fictitious Dirac delta function. This condition gives rise to boundary reactions, where the component is restrained in the complementary condition, and also a displacement field to consider for the complementary case. The Dirac delta function is defined for all field points y and source point p in the volume V as $$\Delta(p, y) = \begin{cases} 0 & y \neq p \\ \infty & y = p \end{cases}$$

$$\int_V \Delta(p, y)\,dV = 1$$

Because the integral of the Dirac delta function is 1 over the volume V, the volume integral of the Dirac delta function and the real load displacement can be reduced such that $$\int_V \Delta(p, y) u dV = u(p).$$

Thus, the choice of the Dirac delta function is useful to eliminate the volume integral term in the reciprocal equation. Also, the traction and displacement fields can be estimated (from classical theory) when a point force of this type is applied at a point source p. These are known functions, called "fundamental equations." For 2D problems, the displacement in the complementary load case in the (i, j) direction is given by $$u_{ij}^* = \frac{1}{8\pi\mu(1-v)}\left[(3-4v)\ln\frac{1}{r}\delta_{ij} + r_i r_j\right],$$

where $\mu$ is the material shear modulus, v is Poisson's ratio, r is the distance between the source point p and the field point y, and the components of r are $r_i$ and $r_j$ in the i and j directions. The traction fundamental solutions are given simply as $$t^* = \frac{\partial u^*}{\partial r}\frac{\partial r}{\partial n}.$$

Thus, the volume integral term is reduced simply to u(p), and a value of $u^*$ and $t^*$ for a given source point p can always be calculated, so the reciprocal theorem equation can be rewritten as $$u(p) + \int_S t^* \cdot u dS = \int_S u^* \cdot t dS.$$

To remove the last non-boundary term in the equation, specify that the point force is somewhere on the boundary and use a constant multiplier c(p)=1 when the fictitious point source is completely inside the material, and c(p)=0 when the point source is on a smooth boundary. Then, the reciprocal equation can be rewritten as $$c(p)u(p) + \int_S t^* \cdot u dS = \int_S u^* \cdot t dS.$$

To integrate numerically the functions $u^*$ and $t^*$, divide the surface S into many small segments or boundary elements. The integration is then performed over small sections of the boundary surface S, and their contributions are added together to complete the surface integrals. In this discrete form, the surface integral equation may be rewritten as $$c(p)u(p) + \sum_{elem}\int_S t^* \cdot u dS_{elem} = \int_S u^* \cdot t dS_{elem}.$$

While the finite order boundary elements, such as constant, linear, or quadratic, etc., are used to provide small areas for numerical integration, the corresponding nodes provide a set of values for interpolation. The discrete form of the boundary integral equation has as its unknowns the displacements and traction distributions around the boundary of the component. This means that when we perform the integrations over every element for any position of the source point, we obtain a simple equation relating all of the nodal values of displacement and traction by a series of coefficients, $$\frac{1}{2}u_i + \hat{h}_{i1}u_1 + \hat{h}_{i2}u_2 + \cdots + \hat{h}_{in}u_n = \hat{g}_{i1}t_1 + \hat{g}_{i2}t_2 + \cdots + \hat{g}_{in}t_n,$$

where i represents the $i^{th}$ component of displacement and n represents the number of nodes on the boundary. In doing so, the whole system of equations can be written in the simple matrix form $$Hu = Gt,$$

where the (n×n) square matrices H and G are called the influence matrices, and the terms inside them are the influence coefficients. Depending on the boundary conditions specified, the above set of algebraic equations can be rearranged and solved for the remaining unknowns. Having found the values of displacement and traction at the boundary nodes, the solution for the internal points can be calculated using $$u(p) + \int_S t^* \cdot u dS = \int_S u^* \cdot t dS,$$

where p is the internal point source.

The calculations at the internal points contain no further approximations beyond those made for the boundary solution. So, as long as an internal point is not so close to the boundary as to make an integral inaccurate, the results there should be just as accurate as the boundary nodal results.

Inclined Wells

The hydraulic fracturing of arbitrarily inclined wells is made challenging by the far more complicated near-well fracture geometry compared to that of conventional vertical wells. This geometry is important both for hydraulic fracture propagation and the subsequent post-treatment well performance. The effects of well orientation on fracture initiation and fracture tortuosity in the near-wellbore region have been studied and reported in Z. Chen and M. J. Economides, "Fracturing Pressures and Near-Well Fracture Geometry of Arbitrarily Oriented and Horizontal Wells," SPE 30531, presented at SPE Annual Technical Conference, Dallas, 1995. These effects indicate an optimum wellbore orientation to avoid undesirable fracture geometry.

Calculating Stresses and Displacements When Far-Field Stresses Are Symmetrical—One-Dimensional Problem (Internal Pressure Change)

As reported in Sathish Sankaran, Wolfgang Deeg, Michael Nikolaou, and Michael J. Economides: "Measurements and Inverse Modeling for Far-Field State of Stress Estimation," SPE 71647, presented at the 2001 SPE Annual Technical Conference and Exhibition, New Orleans, La., Sep. 30-Oct. 3, 2001, a closed form analytical solution is developed to calculate the stress state within an arbitrary number of hollow, concentric cylinders, with known internal and external pressures. However, far-field stress conditions are assumed to be symmetrical, so that the one-dimensional problem is analytically tractable. The results of the closed form analytical solution now are summarized. Consider n concentric hollow circular cylinders of known internal diameter (ID) $a_i$ and outer diameter (OD) $b_i$. These circular cylinders are denoted by indices i, where i=1 refers to the innermost hollow cylinder and i=n refers to the outermost cylinder. Because no void spaces exist between concentric circular cylinders, $a_{i+1}=b_i$. The pressure $P_O$ in the innermost cylinder and the pressure $P_n$ outside the outermost cylinder are assumed known. Each cylinder is assumed to behave in a linear elastic manner with known material properties, while the displacement is continuous between cylinders. The stresses $\sigma_{jk}$ and displacements $u_j$ within cylinder i are given by:

$$\sigma_{rr_i} = 2A_i + B_i\frac{1}{r^2}$$

$$\sigma_{\theta\theta_i} = 2A_i - B_i\frac{1}{r^2}$$

$$\sigma_{r\theta_i}=\sigma_{zz_i}=\sigma_{rz_i}=\sigma_{\theta z_i}=0$$

$$u_{r_i} = \alpha_i A_i r - \beta_i B_i\frac{1}{r}$$

$$u_{\theta_i}=u_{z_i}=0$$

where $\alpha_i$ and $\beta_i$ are functions of each cylinder's elastic constants:

$$\alpha_i = \frac{(1-2\nu_i)(1+\nu_i)}{E_i}$$

$$\beta_i = \frac{1+\nu_i}{E_i},$$

$\nu_i$ is Poisson's ratio, and $E_i$ is Young's Modulus. The constants $A_i$ and $B_i$ are determined from the pressure applied to the ID and OD of cylinder i:

$$A_i = \frac{1}{2}\frac{b_i^2 P_i - a_i^2 P_{i-1}}{b_i^2 - a_i^2}$$

$$B_i = \frac{a_i^2 b_i^2 (P_{i-1} - P_i)}{b_i^2 - a_i^2}.$$

The unknown pressures, $P_i$, between individual cylinders are determined using the requirement of displacement continuity between individual, touching, circular cylinders. Applying the boundary and continuity conditions leads to n−1 discrete, linear equations for the n−1 unknown contact pressures. With this solution, the stresses and displacements can now be estimated using the constants $A_i$ and $B_i$.

The above solution works if the far field stresses are known or symmetrical. However, because that is not often the case, it would be helpful if there were a way to quickly and accurately find the far field stresses, the true well departure angle relative to the principal stress orientation, and to use that information to calculate fracture direction geometries in order to find the most useful placement of a hydraulic fracture.

BRIEF SUMMARY OF THE INVENTION

In one aspect, embodiments of the invention feature techniques for determining and validating the result of a fracturing operation by taking advantage of the accuracy and speed of the boundary equation method of mathematics. While on-line pressure monitoring can provide some useful information about the status of a fracturing operation, it is not enough to characterize completely and uniquely the system, and additional information is required, especially for inclined wells. These measurements monitor the fracturing operation continuously and measure the process variables directly, such as well pressure, wellbore surface stresses, and displacements, which can provide useful on-line information to determine the profile of the propagating fracture.

Use of these embodiments also allows designers and users to better select foam cements and other sheathing materials for their projects. Also, using these embodiments to compare the results for a fractured two-zone case against a non-fractured case will help planners to understand the effect of redistributed stress concentration on the well completion.

Embodiments of the invention feature sensors, for example, piezo-electric sensors, to gather data, such as directional stress measurements from a well site, and model the stress distribution in and around the wells, both in the presence and absence of a fracture. If there is a fracture in the formation, the relative location of the fracture can be interpreted by estimating the stress profile before and after a fracture injection test. The embodiments use processes, which, among other abilities, solve inverse elasticity problems. After determining the fracture profile close to the wellbore, selective and oriented perforation configurations can be calculated and performed, which will provide unhindered flow of fluids from the fracture into the well.

In some cases, the effect of far-field stress asymmetry cannot be excluded in the analysis of multiple zone problems, such as in sheathed wells. For this purpose, embodiments of the invention feature the ability to handle such multiple zone systems.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, shown in the drawings are embodiments, which are presently preferred. It should be understood, however, that the invention is not limited to the precise arrangements and instrumentalities shown.

In the drawings:

FIG. 10 is a comparison of the performance of the boundary element method (BEM) and the conventional finite difference method;

FIG. 11 is a representation of BEM performance;

FIG. 12 is a representation of radial and hoop stress profiles;

FIG. 13 is a representation of displacements;

FIG. 14 is a comparison of a boundary solution with an analytical solution;

FIG. 15 is a representation of a vertical well with known fractured dimensions;

FIG. 16 is a representation of calculated stress profile for representative internal points;

FIG. 17 is a representation of a displacement profile for representative internal points;

FIG. 18 is a representation of a back-calculation of far-field stresses and well departure angle;

FIGS. 19*a* and 19*b* are the comparison of induced radial stress for symmetric far-field conditions and a one-dimensional closed form analytical solution;

FIG. 20 is a representation of the effect of non-symmetrical far-field loading conditions imposed on a two-zone problem;

FIG. 21 is a representation of a uniaxial far-field loading condition;

FIG. 22 is a representation of the effect of modulus on stress induced in a cement layer;

FIGS. 23*a* and 23*b* are representations of a variation in radial stress as pressure declines for a choice of the Poisson ratio and Young's modulus;

FIG. 24 is a representation of the effect of the Poisson ratio as studied by interchanging parameters for two zones;

FIG. 25 is a representation of extending a two-zone problem to investigate the effects of vertical fractures;

FIG. 26 is a representation of an induced stress profile along 5° and a 30° lines while fluid pressure acts outward on fracture faces and inward on a small portion of an interface;

FIGS. 27*a*, 27*b*, and 27*c* are representations of how hoop stress regions within a cement layer and at an interface grow in size as fracturing pressure increases;

FIGS. 28*a*, 28*b*, 28*c*, and 28*d* are representations of the effect of a growing fracture, as simulated by increasing fracture half-length and estimating a new stress distribution;

FIG. 29 is a representation of how hoop stresses can change their loading nature at an interface;

FIG. 30 is a representation showing that most of a load variation is borne by a cement sheath while little variations are reflected in a rock formation; and FIG. 31 is a representation of how changing Young's modulus induces similar behavior as in FIG. 30.

DETAILED DESCRIPTION OF THE INVENTION

For the present invention, the natural boundary conditions are specified in the form of traction at the far-field boundary and internal pressure at the wellbore. However, as will be discussed below for inverse problems, there are cases when the displacements and the internal pressure at the wellbore are the only boundary conditions available. Again, a set of algebraic equations can be rearranged to bring the unknowns to one side and solve for the far-field displacements and traction. The stress profile system of the present invention extends the above development of the boundary integral equations for static stress/displacement to model our specific problem.

Figure 1:
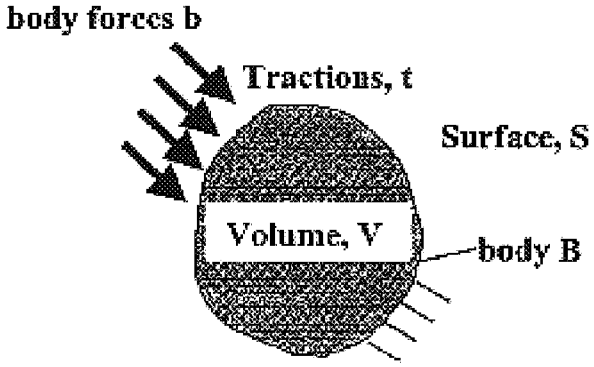
FIG. 1 is a depiction of a hypothetical body subjected to forces.
Figure 2:
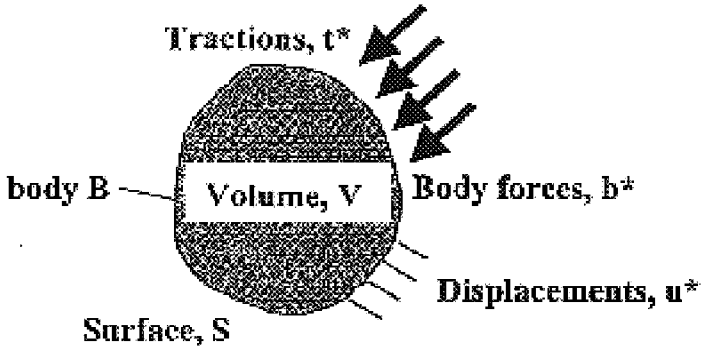
FIG. 2 is a depiction of a complimentary hypothetical body subjected to forces.
Figure 3A:
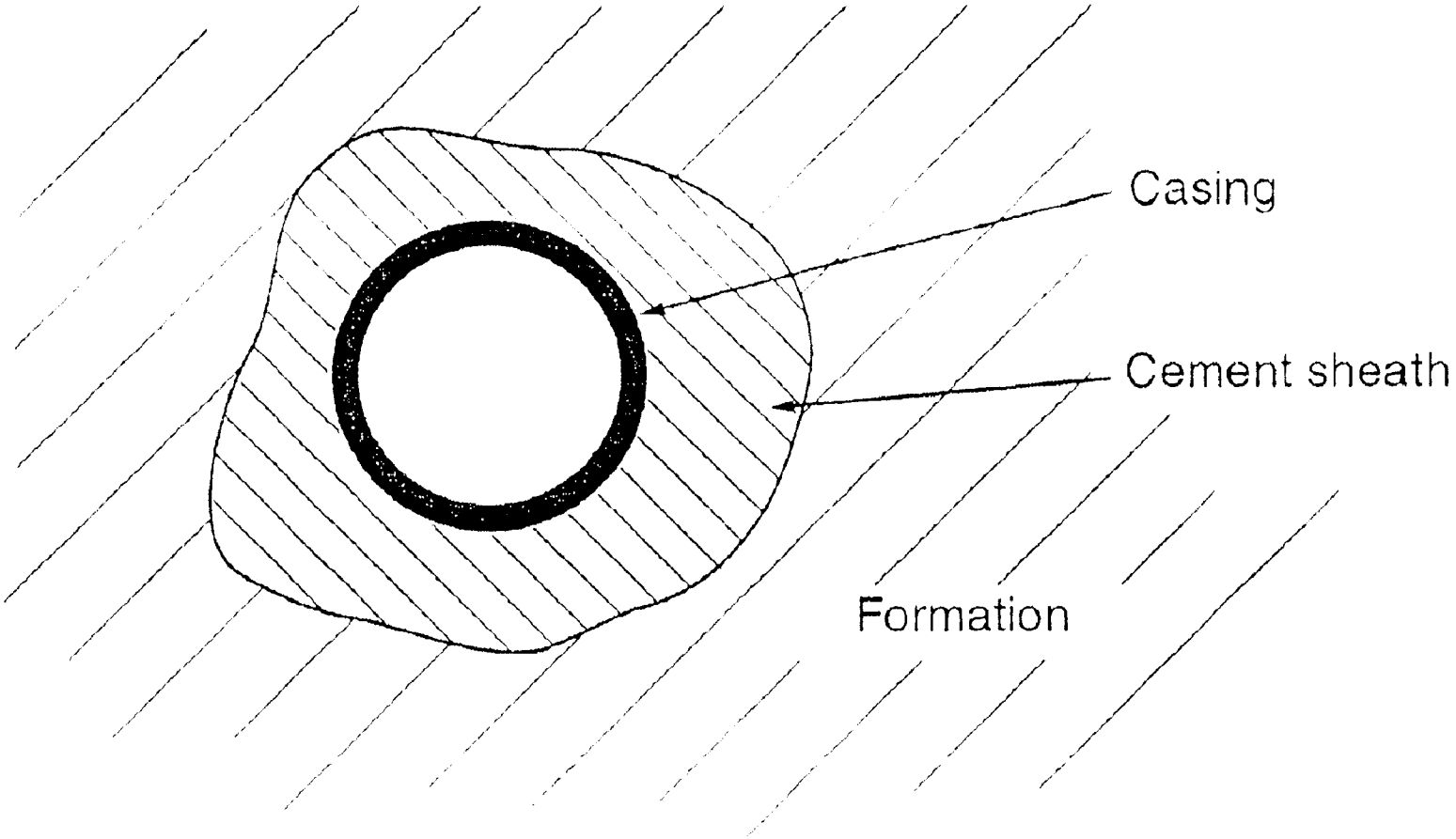
FIG. 3*a* is a cross-section of a wellbore at a given depth location showing a formation, casing, and sheath.
Figure 3B:
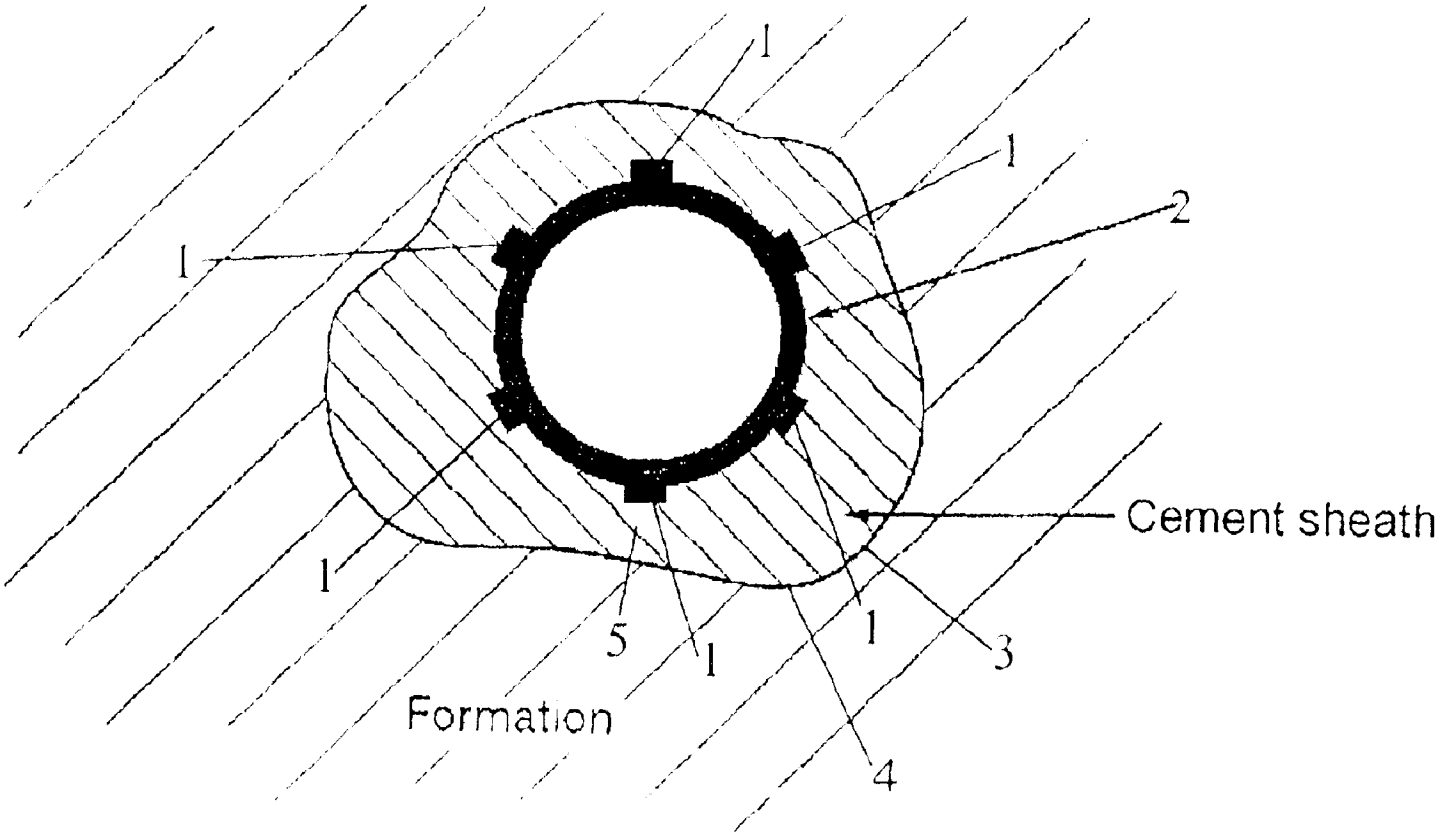
FIG. 3*b* is a cross-section of a wellbore at a given depth location of one array of sensors, in accordance with an embodiment of the invention.

FIG. 3*a* is a cross-section of a wellbore at a given depth location showing a formation, casing, and sheath. In accordance with an embodiment of the stress profile system, at least one array of one or more contact stress sensor 1 is set up (e.g., at a given depth) in or along a casing 2 (e.g., disposed about the circumference of the casing 2) of a wellbore 3, as shown in cross-section in FIG. 3*b*. The sensors 1 are ideally arranged in a coplanar group about the circumference of different sections of the casing 2. The sensors 1 also should be in contact with a contact surface of either a surrounding formation 4 or a sheathing 5 made of a material, such as cement, sealant, gravel pack, concentric casing, or combinations thereof, as shown in FIG. 3*b* (note that cement and sealant are, at times, used interchangeably, as will be appreciated by one skilled in the art). The sensors 1 may be of any type, such as piezo-electric, fiber-optic, acoustic, strain gauges, or any other variety of sensor capable of sensing, recording and transmitting contact stress and pressure perturbation data, as will be appreciated by those skilled in the art. The fiber optic contact stress sensors themselves incorporate piezo-electric, acoustic, or strain gauge sensors for the sensors 1.

Figure 4:
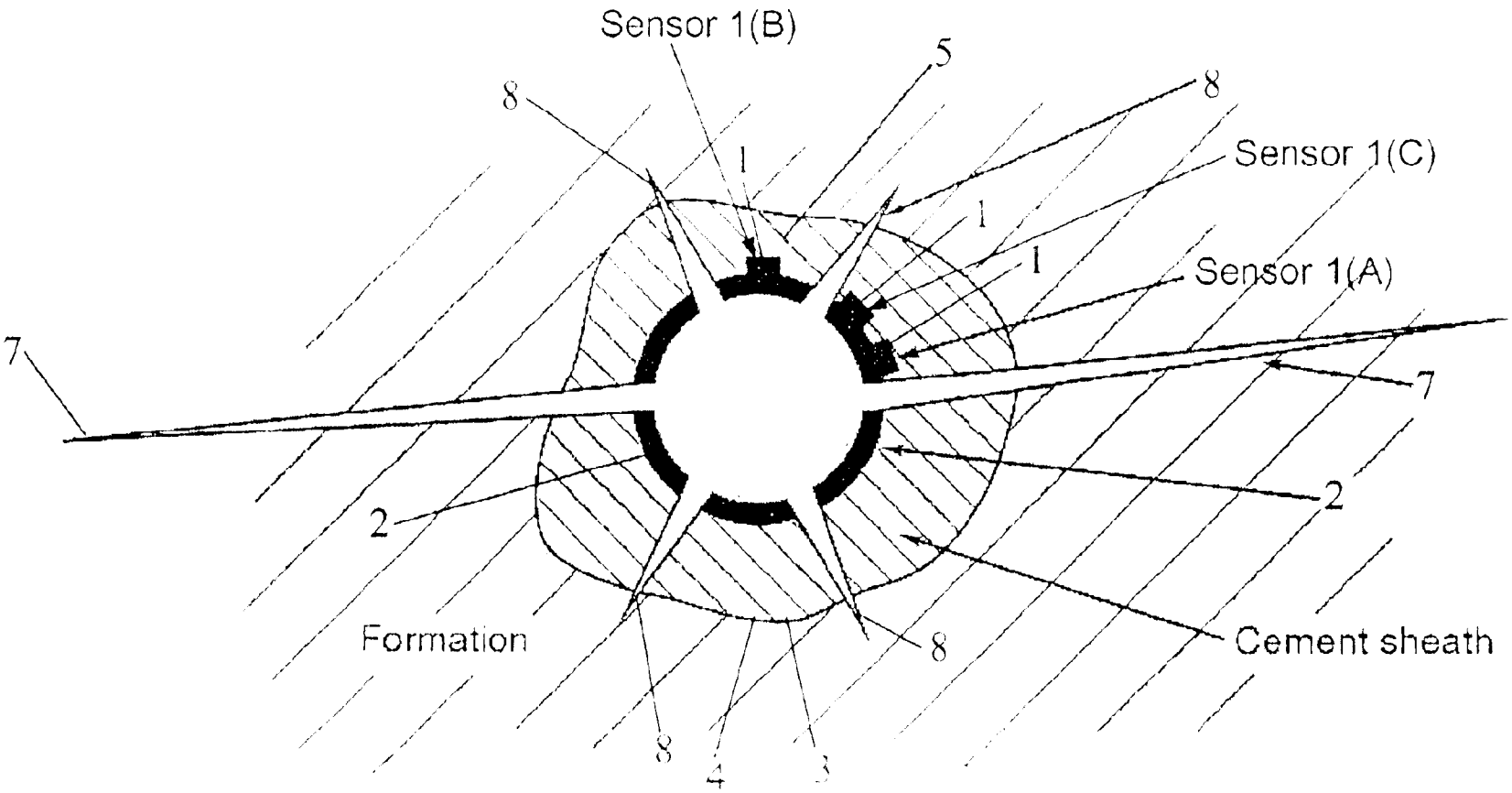
FIG. 4 is a cross-section of a wellbore at the location of one array of sensors, where there are perforations and fractures extending from the wellbore.

The sensors 1 are used to measure contact stresses between the casing 2 and the contact surface 5 (or 4). Then a conventional hydraulic fracture treatment is initiated in the wellbore 3, which perforates the subterranean formation and causes a hydraulic fracture 7 after perforations 8 are first made in the casing 2 in a pre-selected geological test zone, as illustrated in FIG. 4. While the hydraulic fracture treatment is ongoing and after halting, the sensors 1 make more measurements of the contact stresses and pressure perturbations between the casing 2 and the contact surface 5 (or 4), which are used to determine changes induced in the contact stresses between them.

Using the information gathered from the sensors, the stresses throughout the formation 5 (i.e., formation stresses) may be determined using an analyzer. The analyzer may comprise a data processor in a computer system (not shown), or may include a recorder or display attached to the sensor(s) to facilitate manual computations. However, in a preferred embodiment a computer system is used. The computer system can be implemented in hardware, software, or a suitable combination of hardware and software, and which can be one or more software systems operating on a general purpose server platform. As used herein, a software system can include one or more objects, agents, threads, lines of code, subroutines, separate software applications, two or more lines of code or other suitable software structures operating in two or more different software applications, on two or more different processors, or other suitable software structures. In one exemplary embodiment, a software system can include one or more lines of code or other suitable software structures operating in a general purpose software application, such as an operating system, and one or more lines of code or other suitable software structures operating in a specific purpose software application.

In the stress profile system embodiment comprising the computer system, the computer system may be coupled to the sensor(s). As used herein, "couple" and its cognate terms, such as "coupled" and "coupling," includes a physical connection (including but not limited to a data bus or copper conductor), a logical connection (including but not limited to a logical device of a semiconducting circuit), a virtual connection (including but not limited to randomly-assigned memory locations of a data storage device), a suitable combination of such connections, or other suitable connections, such as through intervening devices, systems, or components. In one exemplary embodiment, systems and components can be coupled to other systems and components through intervening systems and components, such as through an operating system of a general purpose server platform. A communications medium can be the Internet, the public switched telephone network, a wireless network, a frame relay, a fiber optic network, other suitable communications media or device, or a suitable combination of such communications media or device.

The stress profile system further comprises measuring a fracturing pressure while performing the hydraulic fracture treatment and using the measured contact stresses recorded during and after performing the hydraulic fracture treatment. (The fracture contact stresses can be the formation stress, closure stress, minimum formation stress, and/or in situ stress, as will be appreciated by those skilled in the art. The formation stress can be initial formation stress, fracture formation stress, and post fracture formation stress.) Then, the subterranean formation is re-perforated according to a preferred orientation of the hydraulic fracture, and a hydraulic fracture treatment aligned with the preferred orientation of the hydraulic fracture is performed.

Figure 5:
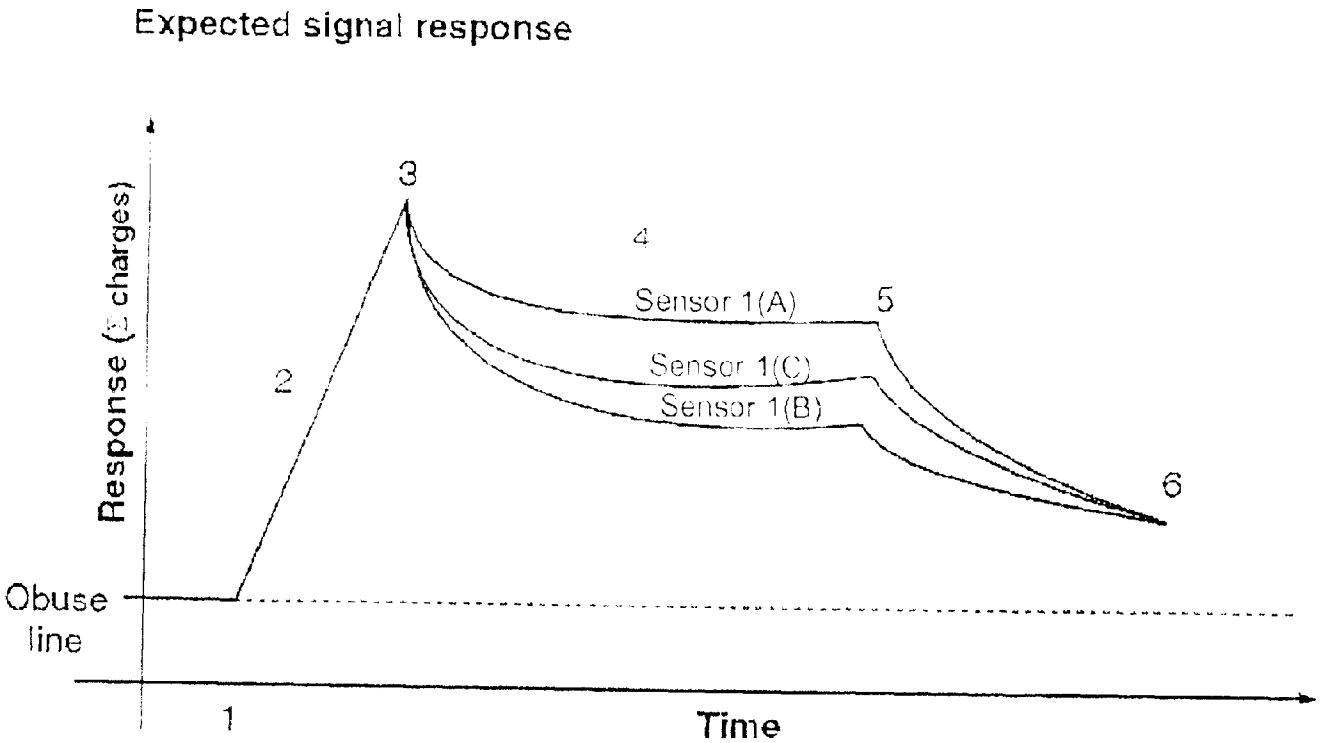
FIG. 5 is a representative display of possible sensor readings during use.
Figure 6B:
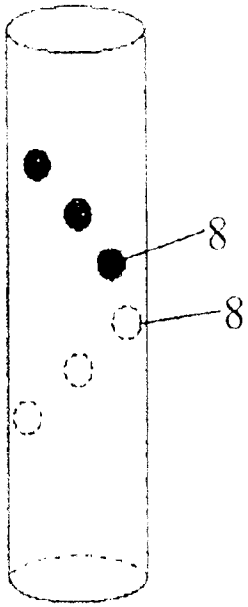
FIG. 6*b* is a perspective view of a perforation pattern in a casing at various depths.
Figure 6A:
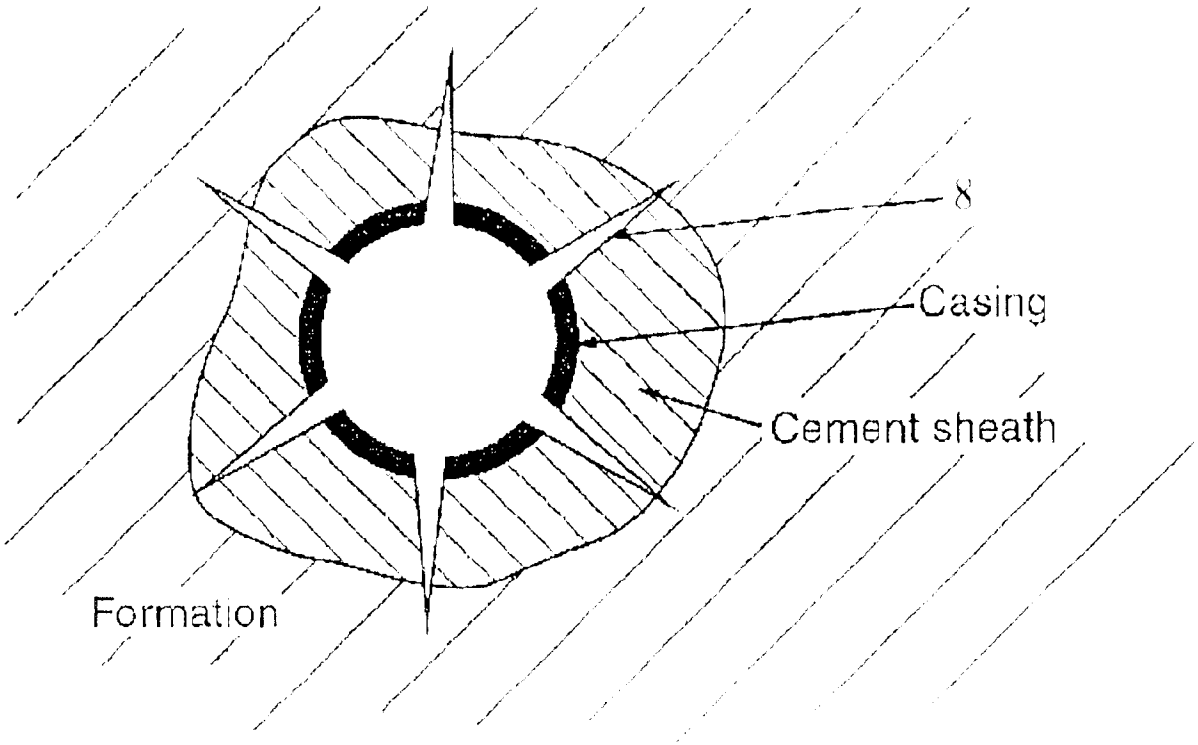
FIG. 6*a* is a cross-section of a wellbore at the location of one array of sensors where the casing has been perforated in a perforation pattern.

FIG. 5 is a representative display of possible sensor 1 readings prior to fracture treatment. The array of sensors 1 is coupled via a signal transmission system to the data processor, such as by individual cables from the array to a surface connection, or conversion of a signal from the sensors 1 (e.g., a mA signal) to an optical signal by fiber optics to a surface connection, or to a location by wireline relay, as will be appreciated by those skilled in the art. The array of sensors 1, the data processor, and the signal transmission system constitute a stress profile analyzer. After analyzing the data, a perforation pattern 8 may be designed that will produce an optimum fracture 7 from the hydraulic fracture treatment, as illustrated in FIG. 6*a*. FIG. 6*b* is a perspective view of a perforation pattern in a casing at various depths that could be designed, in accordance with another embodiment of the invention.

Figure 7:
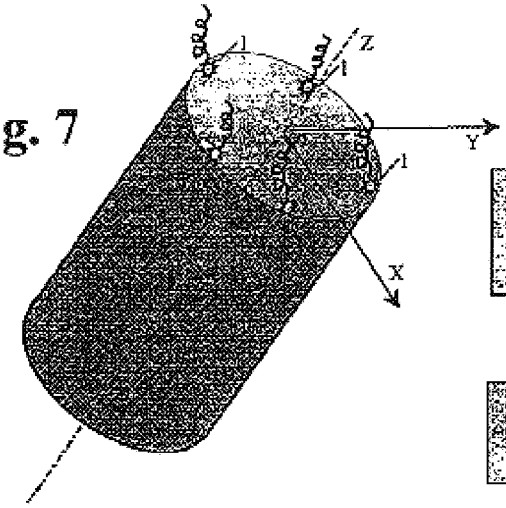
FIG. 7 is a three-dimensional view of an exemplary embodiment of the invention showing a casing, an array of sensors, and a reference coordinate system.
Figure 8:
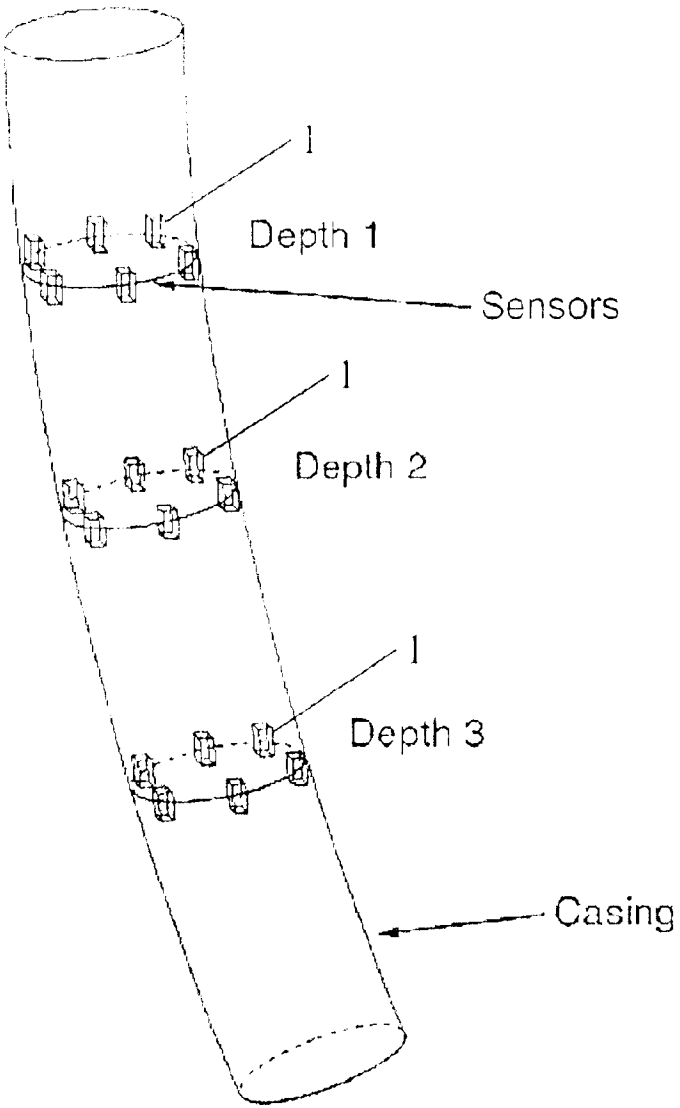
FIG. 8 is a three-dimensional view of a wellbore with arrays of sensors attached to the casing at different depths, in accordance with an embodiment of the invention.

FIG. 7 is a three-dimensional view of an exemplary embodiment of the invention showing a casing, an array of five sensors, and a reference coordinate system. Basically the wellbore-based coordinate system has one axis (z) aligned with the wellbore while the other two axes (x,y) form a plane perpendicular to the wellbore axis. FIG. 8 is a three-dimensional view of a wellbore with ring arrays of sensors 1 disposed along the casing at different depths, in accordance with an embodiment of the invention.

In accordance with an embodiment of the invention, a system for determining the stresses in the area of interest involves using the sensor measurements along with other known data, including mechanical properties, known stresses, and pressures, in boundary element formulas. Following the flow chart of FIG. 9, the casing 2 of the well is perforated at a selected perforation site and the hydraulic fracture 7 is initiated, at block 100. The sensors 1 measure at block 102 the displacement on the borehole surface 5 (or 4) and the internal well pressure. The information measured by the sensors 1 is then processed using a boundary element formula, such as one that will be described below, in order to determine the far-field stresses and the true departure angle of the well. Knowing the far field stresses and the true departure angle of the well relative to the principal far field stress directions, fracture geometries can be modeled to determine the most desired fractured configuration and a subsequent hydraulic fracture may be performed at that point.

Embodiments of the present invention employ the so-called "inverse problem" for field parameter identification in arbitrarily inclined wells. The solution to the inverse problem is concerned with the identification of an unknown state of a system based on the response to external stimuli both within and on the boundary of the system. In other words, inverse problems involve determining causes on the basis of known effects. Inverse problems are found in numerous fields in physics, geophysics, solid mechanics (see, for example, H. D. Bui, "Inverse Problems in the Mechanics of Materials: An Introduction," CRC Press, 1994), such as in applications related to the search for oil reservoirs, medical tomography, radars, ultrasonic detection of cracks (see, for example, J. F. Doyle, "Crack Detection in Frame Structures," in Inverse Problems in Mechanics, S. Saigal and L. G. Olsen (eds.), AMD, Vol. 186, 1994), and others. The progress in applied mathematics has made many of these problems tractable and attractive over the last two decades. The experimental data comes mainly from analysis of both the mechanical stimuli and the response on the boundary of the system. The boundary response is often measured, depending on the accessibility of the boundary. This information is used as feedback to find the optimal unknown state of the system. The stress profile systems and methods of use thereof of the present invention are further illustrated in the following non-limiting examples:

EXAMPLE 1

Calculation of Far Field Stresses from Inverse Formula

The far-field stresses and the true well departure angle (i.e., the angle of departure on a horizontal plane), as shown in P. Valko and M. J. Economides, "Hydraulic Fracture Mechanics," Wiley, West Sussex, 1995, relative to the principal horizontal stress direction are only known with uncertainty. As a result, if the error in these required parameters is large, the resulting near-well fracture geometry and initiation pressures may not accurately depict the real situation. However, by measuring or detecting the internal pressure perturbations, with or without a fracture, and the displacement on the wellbore interior, and processing the information using an inverse elasticity technique, it is possible to calculate the:

1. Far-field stresses;
2. True well departure angle, relative to the principal stress orientation; and
3. Fracture direction (fracture plane geometry).

In such applications in solid mechanics, the problem arises where the boundary conditions on the body of interest (modeled as a linear elastic body in our case) are not sufficiently known in order to give a direct solution. For example, consider a contact problem where it may be difficult to measure accurately the conditions on the boundary in the contact region or a boundary at infinity that is inaccessible. On the other hand, additional information regarding parts of the solution or over-specified boundary conditions on another part of the boundary may be more easily measured. For the application considered herein, that could be in the form of measured displacements on part of the boundary, near the region with unknown boundary conditions. This results in an inverse problem where the goal is to use this additional information to determine the unknown boundary condition. Once the boundary condition is known, the forward problem can then be solved for the displacement, stress and strain fields.

The definition of the inverse elasticity problem follows that of the usual two-dimensional direct elasticity problem with the exception that the boundary conditions are unspecified on the far-field boundary. Instead, additional displacements are specified approximately at discrete locations on the well surface, where tractions are already specified.

Figure 9:
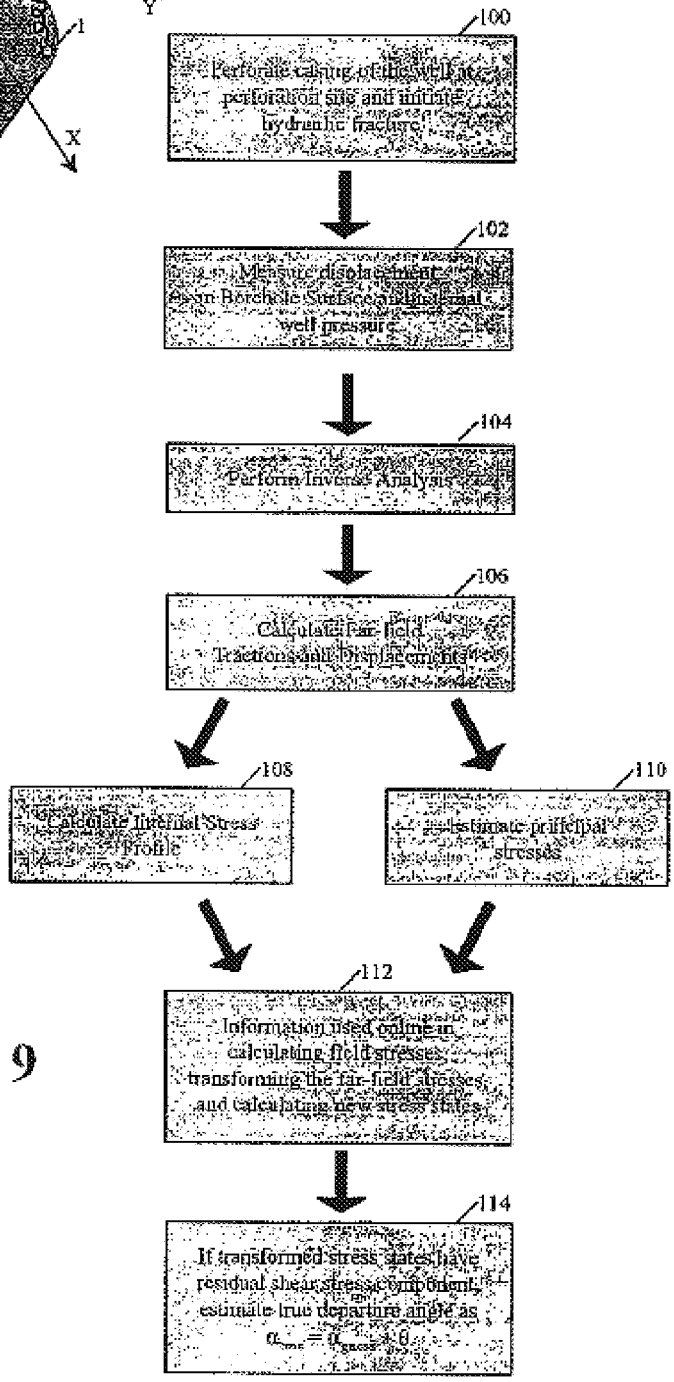
FIG. 9 is a flowchart of a process for measuring the parameters of a site and designing fractures from those measurements.

Referring to FIG. 9, the displacement of the borehole surface and the internal pressure perturbations and processing the data are used in the inverse elasticity analysis, at block 104, to determine (e.g., calculate) a preferred hydraulic fracture orientation. The inverse elasticity formula assumes that the boundary conditions are unspecified on the far-field boundary. Displacements are specified approximately at discrete locations on the well surface 5 (or 4), where tractions are already specified. Summarizing in equation form, $$\mathrm{div}\sigma=0 \text{ on body B}$$

$$\varepsilon=\frac{1}{2}(\nabla u+\nabla u^T)$$

$$\sigma=L[\epsilon]$$

$$e_i\cdot(\sigma\cdot n)=\hat{\sigma}_i \text{ on } \partial B_{1i}, \text{ the surface of B}$$

$$e_i\cdot u(x_\beta)=\hat{u}_i(x_\beta) \text{ on } \partial B_{1i},\ \beta=1, N_s,$$

where $\epsilon$, $u^T$, $\sigma$, n, e, and $N_s$ are the strain tensor, the displacement vector, the stress tensor, the unit normal vector to the external boundary of the body, the unit basis vector, and the number of boundary elements, respectively.

The above equations are general equations. The body B can represent anything upon or through which forces, stresses, displacement, etc. can be measured, calculated or otherwise determined, here the cement sheath, the casing, and the formation, while the well can represent an internal void space within this body. The equations are valid regardless of the geometry being considered. The first three equations are the field equations prescribed on the body B for linear elasticity, where $\sigma$ is the stress tensor, $\epsilon$ is the strain tensor, u is the displacement field, and L is the fourth order elasticity tensor. The fourth equation is the traction boundary condition specified on one boundary (i.e., the wellbore surface 5 (or 4)). The last equation defines the additional displacements prescribed approximately at discrete locations $x_\beta$, $\beta=1$, $N_s$ on the same boundary, while the tractions on another boundary are unknown or only approximately known. The displacements at the wellbore surface 5 (or 4) are known from the sensor 1 measurements. The displacements are dependent on the loads present in the system. Of interest are the displacements at the free surfaces or locations where sensors have been installed.

The boundary element method of the present invention provides a very easy and convenient framework for the solution of the inverse problem, since the far field stress uncertainties and additional displacement measurements on the wellbore surface 5 (or 4) can be directly incorporated into a matrix system equation involving only the boundary values. The unknowns are now far-field tractions and displacements, while the internal pressure and wellbore surface displacements are determined from the sensor 1 measurements. Rearranging the set of algebraic equations, the remaining boundary values can be determined. As described in the forward model above, the influence matrices equation above can be written as $$H_1u_1+H_2u_2=G_1t_1+G_2t_2,$$

where the subscript 1 stands for wellbore surface and the subscript 2 stands for far-field conditions. Rearranging the above equation gives $$[H_2-G_2]\begin{bmatrix}u_2\\t_2\end{bmatrix}=[-H_1+G_1]\begin{bmatrix}u_1\\t_1\end{bmatrix},$$

where the right-hand side is completely known. Determining the far-field traction ($t_2$) and far field displacements $u_2$ using the known wellbore displacements $u_1$ and tractions $t_1$ (block 106 in FIG. 9), the above solution can then be used to estimate the induced stress profile at the internal points within the body B (at block 108 in FIG. 9). The far field principal stresses within the formation can then be determined using techniques familiar to those skilled in the art (block 110 in FIG. 9).

For better accuracy of internal stress contours, which are the stress contours within the body B (i.e., the solid material which includes the sealant or cement, casing, and formation), a large number of boundary elements are used. However, a large number of boundary elements can drive the inverse problem towards stiffness and consequent numerical trouble. This is because the magnitude of the displacements u and the traction t vary over several orders of magnitude, which leads to a very high condition number when the dimension of the system matrix increases. But, if the objective of the inverse problem is solely to compute the far-field conditions and the true well departure angle within reasonable accuracy, then the solution of the inverse problem using a small number of boundary elements, can be used in the forward modeling problem, in accordance with an embodiment of the invention.

EXAMPLE 2

Hydraulic Fracturing in Inclined Wells

In accordance with an embodiment of the invention, a numerical model uses constant boundary elements to compute the induced stress profile in arbitrarily inclined wells. Simulations were obtained by using a general-purpose software code developed in Matlab 5.3. To compare the performance of the BEM embodiment of the present invention with any conventional method, a finite difference model (using central difference formulas) was developed whose results are shown in FIG. 10. (The solid curves are the results of the analytical model whereas the dashed curves are the results of the finite difference numerical model). Apparently, the numerical finite element model was not able to capture the sharp radial stress profile in the near-well region. However, the BEM embodiment of the present invention did a much better job even with coarse meshing on the surface, as shown in FIG. 11. The asterisk '*' denotes the boundary element nodes and the circle 'o' denotes the internal points where the induced stress and displacements are calculated. The radial and hoop stress profiles are shown in FIG. 12 and the displacements are shown in FIG. 13. The boundary solution matches very well with the analytical solution (available for the non-fractured case), as seen in FIG. 14.

EXAMPLE 3

Vertical Well Fracture Analysis

According to the present invention, a linear fracture was introduced into the geometry to the constant boundary elements. A vertical well with known fracture dimensions was considered (see FIG. 15); and the fracture was modeled with sharp intersecting line segments. The surface (inner boundary) is meshed with fine grid size close to the crack tip and coarse grid size everywhere else. The grid sizes are determined by the particular problem being solved and the accuracy desired, as will be appreciated by those skilled in the art. Thus, the element sizes are included as part of the drawings for each case. The calculated stress and displacement profile for representative internal points (away from the fracture orientation) are shown in FIGS. 16 and 17 (note, compressive loading is considered to be positive here). It may be seen that the fractured case experiences a stress relief and, consequently, the stress profiles far away from the fracture experience less variation than before.

EXAMPLE 4

Multiple Zone Problem

A problem that arises during hydraulic fracturing of cemented wells is that of fracture initiation in the cement sheath (e.g., the sheath 5, if present). Internally pressurized wellbores cause the casing to expand, which induces a tensile stress in the surrounding continuous cement sheath. As a result, the fracture initiation is a function of the cement's tensile strength and the tensile stresses induced within the cement sheath. However, the effect of far-field stresses should be included in the field, which is almost always asymmetrical in nature. In effect, both tensile and compressive stresses may act on portions of the cement sheath, thereby making some portions more vulnerable to fracture initiation. The stress distribution in the casing-cement-rock system needs to be estimated as a single continuous problem over disjoint domains.

Figure 17A:
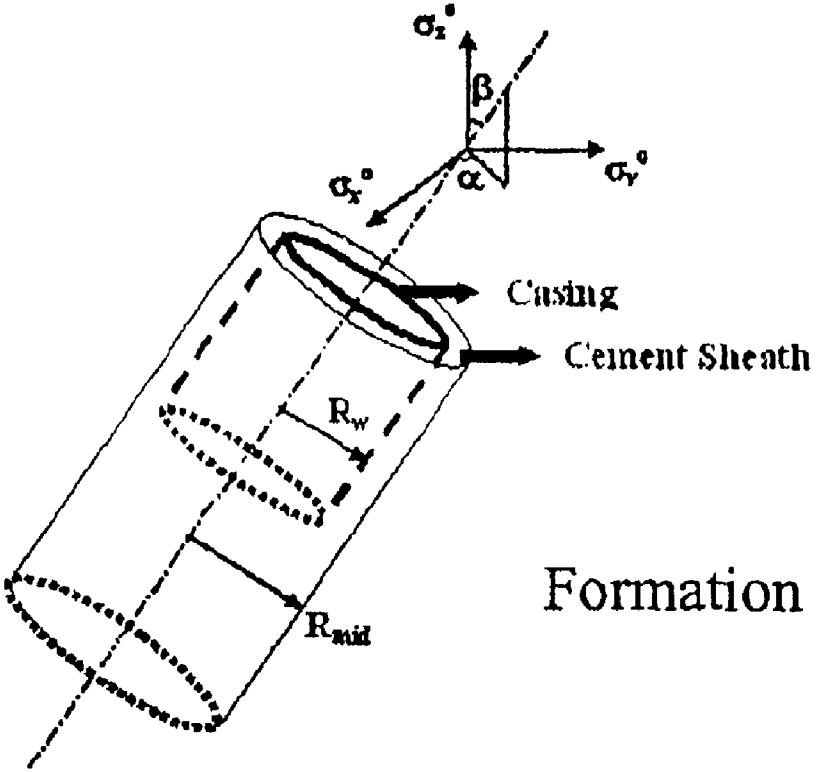
FIG. 17*a* is a schematic representation of an inclined borehole.

The present invention provides solutions to such multiple zone problems (casing-cement-rock system etc.), which provide valuable clues on selection of foam cements and understanding a hydraulic fracturing operation on such systems better. Further, the results for a fractured two-zone case e.g., cement sheath and formation, such as shown in FIG. 17*a*, which is a schematic diagram of an inclined borehole are compared against the non-fractured case to illustrate the effect of redistributed stress concentration on the well completion, e.g., casing or cement sheath, as in FIG. 17*a*. A parametric study of the above cases provides clues to decide on the nature and choice of well completion when hydraulic fracture is considered. Generally, such parametric studies have to be conducted on a case by case basis when the present invention is applied in the design of a hydraulic fracture stimulation treatment.

EXAMPLE 5

Calculation of True Well Departure Angle

In the above Examples, it has been assumed that a reference coordinate system (FIG. 7) is fixed arbitrarily and all results are relative to this coordinate system. However, the well departure angle ($\alpha$) is unknown a priori and hence must be initially estimated based on other information, for example, approximate reservoir data, such as regional stress data and formation layering information, to fix the coordinate system. The inverse problem solution provides the far-field traction, which first should be transformed into far-field stresses according to the following matrix:

$$\begin{bmatrix} P_x \\ P_y \end{bmatrix} = \begin{bmatrix} \cos\theta & \sin\theta & 0 \\ 0 & \cos\theta & \sin\theta \end{bmatrix} \begin{bmatrix} \sigma_x^0 \\ \tau_x^0 \\ \sigma_y^0 \end{bmatrix},$$

where $\theta$ is the departure angle from the x-axis of the borehole coordinate system, and $P_x$ and $P_y$ refer to the contact pressure components at any point around the circumference of the wellbore. Because the set of equations at each source point is an under-specified system to compute the stresses explicitly, the far-field stresses $\sigma$ can be calculated in a least-square optimal manner, as will be appreciated by those skilled in the art. This also helps to obtain consistent estimates over all nodes on the external boundary, in the presence of sensor noise. These far-field stresses are transformed by a rotation matrix from the wellbore based coordinate system to match the vertical axis and assumed departure angle, $$\begin{bmatrix} l_1^2 & 2l_1m_1 & m_1^2 \\ l_1l_2 & l_1m_2 + l_2m_1 & m_1m_2 \\ l_2^2 & 2l_2m_2 & m_2^2 \end{bmatrix} \begin{bmatrix} \sigma_{x^1}^0 \\ \tau_{x^1y^1}^0 \\ \sigma_{y^1}^0 \end{bmatrix} = \begin{bmatrix} \sigma_x^0 - n_1^2\sigma_{z^1}^0 \\ \tau_{xy}^0 - n_1n_2\sigma_{z^1}^0 \\ \sigma_y^0 - n_2^2\sigma_{z^1}^0 \end{bmatrix},$$

where $l_i$, $m_i$, $n_i$ are respective direction cosines and $\sigma_{z^1}^0$ is the principal vertical stress, which is known usually within reasonable confidence limits. The new stress states can now be calculated from the above system of linear algebraic equations, at block 112 in FIG. 9.

If the transformed stress states have any residual shear stress component, then the error in the departure angle can be calculated, at block 114, as $$\theta_{error} = \frac{1}{2}\tan^{-1}\left[\frac{2\tau_{x^1y^1}^0}{\sigma_{x^1}^0 - \sigma_{y^1}^0}\right].$$

Then, the true well departure angle can be estimated as $\alpha_{true}=\alpha_{guess}+\theta_{error}$.

However, the accuracy of the procedure relies on the measurement noise in the sensors employed to obtain the extra information on the wellbore surface. If the measured data is noisy, the error in estimation will propagate through the intermediate values, though least square optimal estimation provides a buffer for tolerance. Also, noisy measurements will make the problem stiff. A brief study of how signal-to-noise ratio affects the inverse problem results indicated that the price for accuracy and benefit from inverse problem approach comes at the cost of reliable and accurate measurements. According to an embodiment of the present invention, the variance of the noise added to the measured data was increased (in simulations) and the inverse problem approach was used to back-calculate the far-field stresses and well departure angle, for a known case. The results are shown in FIG. 18. It may be seen that the well departure angle is more sensitive to noise than the far-field stresses.

For purposes of less stiffness, at least three sensors (measurements) are useful, which will complete the simplest bounded zone (a triangle) needed for the BEM calculations. This comes at the cost of bias due to any noise in these three sensors. The above simulation is an instance realization that indicates trend and qualitative sensitivity towards random white noise.

EXAMPLE 6

Using the Forward Method to Determine Desired Fracture in Sheathed Well

The near-well hydraulic fracture geometry of inclined, sheathed or completed wells is important both for hydraulic fracture propagation and the subsequent post-treatment well performance. The stress distribution in the casing-sheath-formation system needs to be estimated as a single continuous problem over disjoint domains. Utilizing an embodiment of the present invention, a fundamental study of such multiple zone problems (casing-cement-rock system, etc.) provides valuable clues on the selection of foamed cements and understanding a hydraulic fracture treatment on such systems better. Further, the results for a fractured two-zone case (cement sheath and formation) are compared against the non-fractured case to understand the effect of redistributed stress concentration on the well completion (casing or cement). A parametric study of these cases provides clues to decide on the nature and choice of well completion when hydraulic fracturing is considered

EXAMPLE 7

Two-Dimensional Problem (Asymmetrical Far-Field Stresses)

In some cases, the effect of far-field asymmetry cannot be excluded in the analysis of multiple zone problems. For this purpose, a generalized numerical scheme using the boundary element technique according to an embodiment of the present invention, effectively handles multiple zone systems. For simplicity, a two-zone system or model is used to represent the cement sheath (inclusive of the casing) surrounded by the formation.

Zones are boundary element models in their own right, being closed regions bounded by a set of elements. They share a common set of elements with the adjacent zones. These "interface" elements, which are completely within the material and not on the surface, form the connectivity between the various zones. This zone approach, according to an embodiment of the present invention, can be employed when a component consists of two or different materials, when components have high aspect ratio, when elements become close together across a narrow gap leading to inaccurate results or when computational efficiency needs to be improved. The boundary element discretization herein illustrates the two-zone system. In the two-zone system, in accordance with an embodiment of the invention, using BEM, the different zones are considered as totally separate boundary element models during the entire phase of building the influence matrices. Once the zone system matrices are generated, they can be combined into a single system matrix for the whole problem by simply adding the matrices together. The nodes on the interface elements will have twice the number of degrees of freedom as boundary nodes, because the results may be different in the two zones. For the two-zone model, for example, the matrix equation can be written as $$\begin{bmatrix} H_1 & H_I^1 & 0 \\ 0 & H_I^2 & H_2 \end{bmatrix} \begin{Bmatrix} u_1 \\ u_I \\ u_2 \end{Bmatrix} = \begin{bmatrix} G_1 & G_I^1 & 0 \\ 0 & -G_I^2 & G_2 \end{bmatrix} \begin{Bmatrix} t_1 \\ t_I \\ t_2 \end{Bmatrix},$$

where the degrees of freedom have been split into the boundary variables ($u_1$, $t_1$, $u_2$, $t_2$) and interface variables ($u_I$, $t_I$). This gives a matrix equation that is very similar to the original single zone equation, but in which there is a coarse level of banding.

Figure 19A:
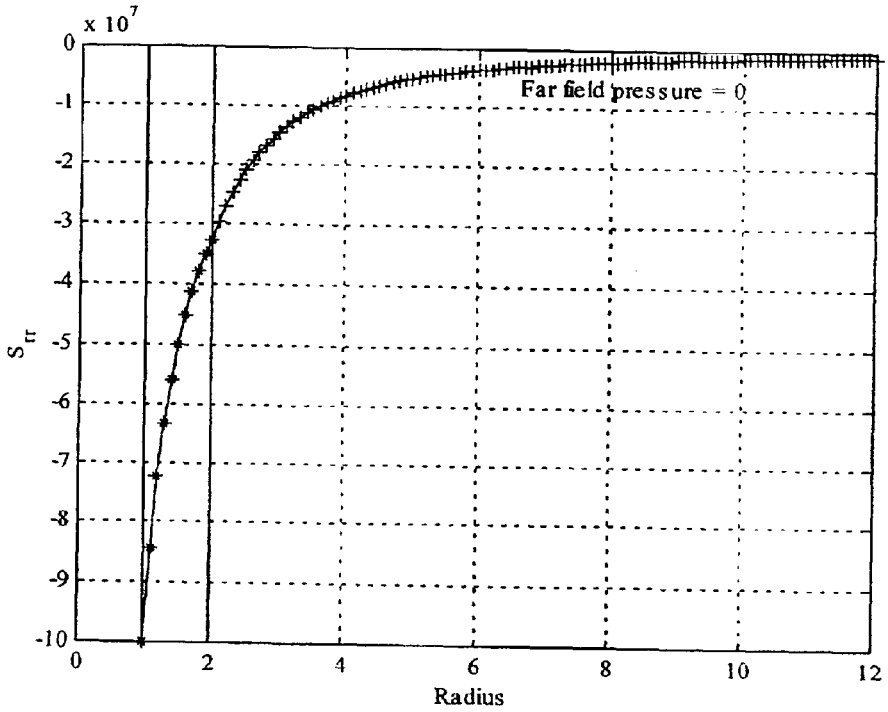

The induced radial stress for the special case of symmetric far-field conditions is compared against the one-dimensional closed form analytical solution in FIG. 19*b* (see FIG. 19*a* for simulation parameters). FIG. 20 shows the effect of non-symmetrical far-field loading conditions imposed on the two-zone problem, for a constant internal pressure. According to an embodiment of the present invention, by alternating the loading condition, the stress profile assumes an appropriate symmetrical shift. The extreme case of an uniaxial far-field loading condition is shown in FIG. 21. In all of the above simulations, the material properties and geometry are held constant. For the next simulation according to an embodiment of the present invention, the Young's moduli of the two zones are interchanged to see the effect of using foamed cement against neat cement. Illustrative of the present invention, FIG. 22 shows that the stress induced within the high modulus cement layer is higher than that induced in the low modulus cement layer. Thus, for a given wellbore internal pressure, a fracture is more likely to initiate in a high modulus cement sheath than a low modulus cement sheath. Finally, the internal pressure is allowed to decline to observe the transition of induced stress state within the cement sheath and along the interface. In particular, as the pressure declines from 100 MPa to 50 Mpa (see FIGS. 23*a* and 23*b*), most of the variation in the radial stress is confined to the inner cement layer for the choice of Poisson ratio and Young's modulus. Finally, the effect of Poisson's ratio is studied by interchanging the parameters for the two zones (see FIG. 24), which indicates a higher radial stress induced in the inner cement layer than before.

The two-zone problem, according to an embodiment of the present invention, can be further extended to investigate the behavior in the presence of vertical fractures, as shown in FIG. 25. Elliptical cracks of known half-lengths are considered, which are assumed to be vertical for a regular vertical well. Radial and hoop stress profiles are estimated along two different lines—a 5° line, running close to the fracture tip and a 30° line, away from the fracture. While the fluid pressure acts outwards on the fracture faces and inwards on a small portion (10° arc) of the interface, the induced stress profile along the 5° and 30° lines varies considerably (see FIG. 26), especially at the interface between the cement sheath and the formation. Due to the far-field asymmetry and the combination of parameters, some portions of the cement sheath may be under compressive loading while other portions are under tensile loading (note, negative values denote compressive loading and positive values denote tensile loading). This will selectively determine the fracture initiation points in the cement sheath and eventually determine the fracture plane and directions in the rock formation. Further, the impact of the presence of the fracture is predominantly felt closer to the fracture, where tensile radial stresses are encountered, while further from the fracture, it could still be compressive, as seen from the radial stress profiles. This is illustrative of an important consideration in the inverse problem and the required data acquisition. In addition, the hoop stresses may change within the cement sheath from compressive to tensile as we approach the interface with the rock, which can dictate secondary fracture initiation points, if any. From FIGS. 27*a*, 27*b* and 27*c*, it is shown that with increasing fracturing pressure, the tensile hoop stress regions within the cement layer and, consequently, at the interface, grow in size. According to an embodiment of the present invention, increasing the fracture half-length and estimating the new stress distribution (see FIGS. 28*a*, 28*b*, 28*c*, and 28*d*) simulates the effect of a growing fracture. Both the radial and hoop stress become more compressive (less tensile) with increasing fracture length in the rock, near the fracture tip for the 5° line. Along the 30° line, a similar result is observed, which reduces the tensile stresses on the interface with increasing fracture length. It should be noted that for the 5° line, the stress profiles are computed only beyond the fracture half-length, while for the 30° line, the stress profiles are estimated beyond the interface. By interchanging the principal far-field stresses, it may be observed (see FIG. 29) that the hoop stresses can change their loading nature (tensile to compressive) at the interface. According to an embodiment of the present invention, the effect of changing the Poisson ratio of the two zones may be studied by interchanging the parametric values (with the original fracture half-length), which shows a reversal of behavior, in particular, in the cement sheath. It may be seen from FIG. 30 that most of the load variation is borne by the cement sheath, while little variation is reflected in the rock formation. Similarly, changing the Young's modulus induces a similar behavior, as is shown in FIG. 31.

According to an embodiment of the present invention, the presence of multiple zones with different properties can produce a whole array of stress contrast situations at the interface and within the cement sheath. Though all these simulations are not comprehensive to capture the gamut of possibilities of interacting parameters, they are not limiting, and provide a framework and means to explore situations of particular interest.

The above techniques will selectively determine the fracture initiation points in the cement sheath and eventually determine the fracture plane and directions in the rock formation. Knowledge of the fracture plane and directions allows designers to choose the locations for further fracturing or whether it would be better to avoid using that particular well at all.

EXAMPLE 8

Evaluating Sheathing Materials

It would be valuable for well designers to know the effectiveness of different sheathing materials and their effect on fracturing. In accordance with an embodiment of the invention, use of the sensor arrays 1 during the curing process enables designers and users to assess the state of the entire well structure. According to an embodiment of the present invention, the step of monitoring the contact stress between the casing and the cement or sealant sheath as the cement or sealant cures is initiated. If the contact stress does not change, the cement or sealant does not shrink. If the contact stress decreases, the cement or sealant shrinks. But, if the contact stress increases, then either the formation is closing in on the cement or sealant sheath or the cement or sealant sheath is expanding. According to this embodiment of the present invention, this method is used to assess the degree of shrinkage of a sealant between a casing and a formation. In this technique, a stress profile analyzer having a contact stress sensor array and a data processor could be used. The contact stress sensor array would be installed on the wellbore casing. The contact stress between the casing, sealant and formation would be measured while the sealant is curing and a shrinkage value calculated based on the change in contact stress over time using a basing analytical elasticity algorithm. Similarly, the bond quality between the casing and the cement or sealant sheath could be assessed. In this case, for example, to assess bond quality between the casing and the sealant, the stress profile analyzer having the contact stress sensor array and the data processor also is used. The contact stress sensor array would be installed on the wellbore casing, pressure would be applied to an inside diameter of the casing, and the induced contact stress between the casing and sealant would be measured. Then, the induced contact stress measurements would be used to determine when a contact occurs between the casing and the sealant and a casing deflection calculated to establish contact between the casing and sealant.

Accordingly, boundary element methods have been used to model the induced stress distribution in arbitrarily inclined wells, both in the presence and absence of fracture. The results for inclined wells before fracture are in excellent agreement with the analytical results for even large grid sizes, which illustrates the superior accuracy and computational speed of these boundary element methods, according to the invention.

A multiple zone model has been developed, according to the invention, to study the effect of well completion (namely cemented completion) on fracture initiation and fracturing pressure. It has been shown that the material properties (Young's modulus, Poisson ratio) of the cement can greatly influence the stress distribution and consequently, the initiation point. For lower fracturing pressures, the cement sheath may be subject to both tensile and compressive stresses simultaneously, which may cause selective failure and influence the fracture orientation in the formation. Complementary simulations are performed on a two-zone model, with pre-existing fracture, which show that the stress relief due to the presence of fracture affects the induced tensile stress in the cement sheath.

Boundary elements have been used in a suitable framework to pose an inverse elasticity problem, according to the invention. BEM is used to model linear elastic fracture mechanic equations for the purpose of our application. This eliminates the necessity for nested iterative algorithms, which are unavoidable, if domain integral methods (such as finite difference methods, finite element methods, etc.) are used. The generalized software code mentioned above for the boundary element model also can be used to solve the inverse problem by rearranging the matrix equations. Avoiding noisy measurements and obtaining accurate downhole measurements are useful in solving the inverse problem, as described herein.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method to determine the preferred fracture orientation for optimized hydraulic fracture treatments in a wellbore, comprising: providing a stress profile system having a contact stress sensor; locating said contact stress sensor; measuring contact stress between a casing and a contact surface disposed about the casing; perforating the casing in a pre-selected geological test zone; performing a hydraulic fracture treatment within the test zone to induce changes in the contact stress; measuring changes induced in the contact stress between the casing and the contact surface; determining formation stress around the wellbore; and determining a preferred hydraulic fracture orientation.

2. The method of claim 1, wherein the step of determining the formation stress comprises: measuring a fracturing pressure during the step of performing a hydraulic fracture treatment within the test zone; and measuring post fracture contact stress at the test zone after performing a hydraulic fracture treatment within the test zone.

3. The method of claim 2, further comprising the steps of: re-perforating the subterranean formation according to the preferred orientation of the hydraulic fracture; and performing a hydraulic fracture treatment aligned with the preferred orientation of the hydraulic fracture.

4. The method of claim 3, wherein the post fracture contact stresses is selected from the group consisting of formation stress, fracture closure stress, minimum formation stress, and in-situ stress.

5. The method of claim 4, wherein the post fracture stress is the formation stress.

6. The method of claim 4, wherein the post fracture stress is the fracture closure stress.

7. The method of claim 4, wherein the post fracture stress is the minimum formation stress.

8. The method of claim 4, wherein the post fracture stress is the in-situ stress.

9. The method of claim 4, wherein the step of determining a preferred hydraulic fracture orientation comprises determining the far field stress and a fracture geometry.

10. The method of claim 9, wherein the step of determining a preferred hydraulic fracture orientation comprises calculating a preferred hydraulic fracture orientation according to the following equations:

$$\mathrm{div}\sigma=0 \text{ on body B}$$

$$\varepsilon = \frac{1}{2}(\nabla u + \nabla u^T)$$

$$\sigma=L[\epsilon]$$

$$e_i\cdot(\sigma\cdot n)=\hat{\sigma}_i \text{ on } \partial B_{1i}, \text{ the surface of B}$$

$$e_i\cdot u(x_\beta)=\hat{u}_i(x_\beta) \text{ on } \partial B_{1i},\ \beta=1,N_s.$$

11. The method of claim 10, wherein the step of calculating the formation stress comprises: measuring a fracture formation stress during the step of performing a hydraulic fracture treatment within the test zone; measuring a post fracture formation stress after the step of performing a hydraulic fracture treatment within the test zone.

12. The method of claim 11, wherein the formation stress comprises the initial formation stress, fracture formation stress and post fracture formation stress.

13. The method of claim 12, wherein the step of determining a preferred hydraulic fracture orientation comprises calculating far field stress data, a well departure angle and a fracture plane geometry.

14. The stress profile analyzer of claim 13, wherein the effect of the pressure perturbation on a contact stress may be determined by the data processor.

15. The stress profile analyzer of claim 14, wherein the contact stress sensor array comprises three or more contact stress sensors disposed about the circumference of the casing.

16. The stress profile analyzer of claim 15, wherein the contact surface is selected from the group consisting of a cement sheath, formation, gravel pack, concentric casing and combinations thereof.

17. The stress profile analyzer of claim 16, wherein the contact surface is the cement sheath.

18. The stress profile analyzer of claim 16, wherein the contact surface is the formation.

19. The stress profile analyzer of claim 16, wherein the contact surface is the gravel pack.

20. The stress profile analyzer of claim 16, wherein the contact surface is the concentric casing.

21. The stress profile analyzer of claim 15, wherein the contact stress sensors comprise fiber optic sensors.

22. The stress profile analyzer of claim 15, wherein the fiber optic sensors comprise piezo electric sensors.

23. The stress profile analyzer of claim 15, wherein the fiber optic sensors comprise acoustic sensors.

24. The stress profile analyzer of claim 15, wherein the fiber optic sensors comprise strain gauge sensors.

25. The method of claim 15, wherein the step of determining a preferred hydraulic fracture orientation comprises calculating a preferred hydraulic fracture orientation according to the following equations:

$$\mathrm{div}\sigma=0 \text{ on body B}$$

$$\varepsilon = \frac{1}{2}(\nabla u + \nabla u^T)$$

$$\sigma=L[\epsilon]$$

$$e_i\cdot(\sigma\cdot n)=\hat{\sigma}_i \text{ on } \partial B_{1i}, \text{ the surface of B}$$

$$e_i\cdot u(x_\beta)=\hat{u}_i(x_\beta) \text{ on } \partial B_{1i},\ \beta=1,N_s.$$

* * * * *